US005803627A

United States Patent [19]

Paranjpe

[11] Patent Number: 5,803,627

[45] **Date of Patent: *Sep. 8, 1998**

[54] COMBINATION INK OR DYE RIBBON AND APPARATUS FOR NONIMPACT PRINTING

[76] Inventor: Suresh C. Paranjpe, 2105 Ridge Point Dr., Lake Oswego, Oreg. 97034

[ * ] Notice: The term of this patent shall not extend beyond the expiration date of Pat. No. 5,445,463.

[21] Appl. No.: 455,019

[22] Filed: May 31, 1995

Related U.S. Application Data

[62] Division of Ser. No. 39,871, Mar. 30, 1993, Pat. No. 5,445,463.

[51] Int. Cl.[6] ..... B41J 33/00

[52] U.S. Cl. ..... 400/240; 400/237

[58] Field of Search ..... 400/240, 240.1, 400/240.2, 240.3, 237, 240.4, 249, 120.02

[56] References Cited

U.S. PATENT DOCUMENTS

| | | | |
|---|---|---|---|
| 4,630,069 | 12/1986 | Erlichman | 400/216.1 |
| 4,638,330 | 1/1987 | Watanabe | 400/240.4 |
| 4,666,320 | 5/1987 | Kobayashi et al. | 400/241.1 |
| 4,704,615 | 11/1987 | Tanaka | 400/120 |
| 5,064,301 | 11/1991 | Nakamura et al. | 400/120 |
| 5,248,994 | 9/1993 | Yoshida et al. | 400/232 |

FOREIGN PATENT DOCUMENTS 4125180 4/1992 Japan .

*Primary Examiner*—Ren Yan

*Attorney, Agent, or Firm*—Marger, Johnson, McCollom & Stolowitz, P.C.

[57] ABSTRACT

A nonimpact printer accommodates ribbons of selected panel types such as y, m, c and black thermal transfer or dye diffusion, precoat, overcoat, and the like, or combinations thereof, on which ribbon identification data is recorded in terms of the number and disposition of such panels, optimum operating parameters and the like. Each ribbon also contains markers identifying sets of panels of different types, individual panels within such sets, and incremental positions within such panels, and the printer is designed to read such markers and record the movement of the ribbon therethrough. Means are also described for fabricating combination ribbons that employ more than one of the various nonimpact technologies. In addition, the printer records by several different means the ribbon positions at which a ribbon has been in use and provides means for moving the ribbon to unused portions thereof. Such usage data are also recorded in a non-volatile memory chip attached to the ribbon cassette, so that they can be recovered and used after a power failure or after the cassette has been removed and replaced.

18 Claims, 9 Drawing Sheets

COMBINATION INK OR DYE RIBBON AND APPARATUS FOR NONIMPACT PRINTING

This is a division of application Ser. No. 08/039,871, filed Mar. 30, 1993, now U.S. Pat. No. 5,445,634.

BACKGROUND OF THE INVENTION

1. Field of the Invention

This invention relates to an image forming apparatus that uses an ink or dye ribbon, including electroresistive ribbon types, and one or more forms of energy to cause the transfer of a selected portion of ink or dye or the like to a substrate to prepare (i.e., precoat) that substrate for subsequent image formation, to overcoat an image already formed, to form an image directly, or to form an intermediate image for subsequent transfer to form a permanent image. More precisely, this invention relates to a series of combination ribbon types that include more than a single kind of ink or dye panel, especially panels of different sizes, types and colors and/or black, white or transparent or the like. In a second aspect, the invention relates to apparatus that permits selection of desired panels within a particular installed ribbon for use, while also taking account of which panels or parts of panels have already been used, even if a ribbon has been removed and reinstalled or is installed into a different printer that also embodies the features of the invention.

2. Background Information

U.S. Pat. No. 4,503,095 issued Mar. 5, 1985 to Seto et al. describes a heat-sensitive color transfer medium comprising a foundation on a front side of which, in repeating units, is disposed a multiplicity of equal-sized areas coated with heat-sensitive inks of differing colors. One embodiment of the Seto et al. medium includes within the repeating unit coated areas having the primary colors yellow, magenta and cyan, and a second embodiment also includes within the repeating unit an area of black. The transfer of ink is caused by electrical pulse signals for each color that have been defined to reproduce the desired composite image, which signals are transmitted to a thermal head. Superposition of the yellow, magenta and cyan colors upon a substrate of the same size as the coated areas permits the transfer either of multicolor or black images. When using a medium that includes a black area, a black image can be formed simply by transfer of the black ink.

Seto et al. describes alternative embodiments of the invention in which the medium may be of a single line width, to be used with a serial printer equipped with appropriate thermal heads which encompass that same width, whereby the medium and thermal head must both be moved across the substrate in order to form the full image of a particular color; and a second embodiment in which the medium has the same dimension as the substrate and thus only the thermal head must be moved to form that full image. However, in either such embodiment the Seto et al. invention is specifically limited to devices in which the coated areas of the ink transfer medium all have a longitudinal dimension which matches the corresponding dimension of the substrate to which the image is to be transferred.

U.S. Pat. No. 4,616,236 issued Oct. 7, 1986 to Watanabe et al. describes a color ribbon and apparatus by which, based upon the size of the substrate to which a transfer is to be made, if an image to be transferred encompasses less than one half of a color panel, only one-half of the panel is used in a first color transfer, and the unused portion of the color panel can be used later for a second color transfer from that same panel. Since prior art devices ordinarily placed the image to be transferred in a position corresponding to the center of the color panel, the unused portions of the panel in such a device will consist of two separate portions lying on either side of the used portion and will thus not be readily amenable for use. Therefore, the Watanabe et al. '236 device makes provision for aligning the first image of less than one-half panel size with the forward or leading half of the panel, whereby the unused portion of that panel, i.e., the rear or trailing half, constitutes a single portion of like size that by means of reversible motors can be positioned for subsequent use. Operation of the Watanabe et al. '236 device presumes that at the outset the color transfer ribbon has not been used, so that when operating in the mode in which each color panel is to be used twice, a counting device is used to establish an even or odd copy count and thereby to provide for use of the leading or trailing halves of each color panel, respectively. Bar codes disposed along an edge of the transfer ribbon are read by a bar code sensor to control the ribbon drive motors and thus to position the ribbon panels as required. A limitation of the device, however, is the inability to distinguish used from unused panel portions on other than a one-half basis, i.e., to identify and then position for use various unused panel portions in general, as to ribbons that are both already and newly installed.

U.S. Pat. No. 5,104,247 issued Apr. 14, 1992 to Ohshima describes ribbons having ink panels of a length that may greatly exceed the size of the paper onto which an image is to be transferred. It is also presumed that in the prior art, panels of different colors will be individually marked by bar codes so as to identify the color of each. It would thus be the practice to wind such a ribbon (as mounted in a ribbon cassette) through the printer until a panel of a desired color was found, thereby passing over panels of other colors that would not have been used. Also, if the amount of printing (i.e., length of required color panel) was greater than the length of a particular color panel in use, to complete that printing it would be necessary first to interrupt that printing and then to wind through the ribbon again until another panel of that same desired color was found, which would again pass over panels of other colors. The use of longer color panels on the ribbon to accommodate more printing of a particular color at a time was not viewed as a complete solution to the above problem for the reason that when printing on smaller documents (e.g., post cards), substantial portions of such longer ribbon panels would similarly need to be passed over to get to a next-desired color panel. Inclusion of shorter color panels for such purposes would similarly be impractical, and could result in error because of the need to identify both the color and size of a panel.

The Ohshima '247 patent thus describes a method and apparatus for virtually dividing long and continuous panels of each particular color, as detected by detection means from bar codes interposed in between such color panels, into a preselected number of areas and carrying out the desired printing in units of such divided areas. The ribbon has a width appropriate for single line printing, hence the length of each such area is preferably slightly longer than one line length, i.e., than the width of the document to which the image is to be transferred. Discrimination means formed in the cassette are first employed to determine whether or not a particular ribbon is intended to be so divided, based upon whether or not the user has broken off a lug thereon prior to installation in the printer. If divisional use is indicated, the user must also input to the printer the number of fractional areas (e.g., areas A, B, and C) into which the total length of an inked region is to be divided. Upon fully traversing a ribbon using one area (e.g., A) for a particular color, a "use count" N is initiated that will subsequently cause positioning of the ribbon so that an as-yet unused area (e.g., B) becomes aligned with the print head for use. Additional discrimination means are employed to indicate to the printer that a particular ribbon is, e.g., monochromatic.

U.S. Pat. No. 4,704,615 issued Nov. 3, 1987 to Tanaka encompasses the thermal transfer of either a white or transparent ink layer onto a substrate prior to the transfer thereto of primary color inks to form the desired multicolor image. The "white" signal is generated by passing the yellow, magenta and cyan signals through an OR circuit so that white or transparent ink is first transferred to every location at which any or all of the yellow, magenta or cyan inks are to be transferred so as to smooth the surface to accept those latter inks. As in the Seto et al. '095 device, the color panels are of the same size as the substrate and are arranged on the transfer medium in the usual order of use; e.g., as white, yellow, magenta and cyan.

U.S. Pat. No. 4,977,058 issued Dec. 11, 1990 to Miyagawa et al. treats the speed at which thermal printing can be carried out, since thermal transfer (i.e., the heating and cooling of the elements of a thermal head) occurs at a much slower rate than, e.g., electric current or light, and also the fact that full color printing generally requires three successive operations to encompass the yellow, magenta and cyan colors, which introduces the problem of accurate image registration as well as the expenditure of considerable amounts of printing time. The use of image transfer materials that are sensitive to light only has been described, e.g., combinations of chromogenic materials and an encapsulated radiation curable composition, or a developer and a photosensitive microencapsulated material, but the use of such materials is limited by the high levels of light intensity required to effect exposure, the instability of the resultant image, the need to apply pressure in the microencapsulated case, and the poor storage stability of such materials. In consequence, the Miyagawa et al. '058 patent describes a layered transfer recording medium in several embodiments that is acted upon by both light and heat so as to bring about changes in medium parameters such as a softening, melting or glass transition temperature or the viscosity in the transfer layer. Image transfer requires special apparatus in the printer, i.e., a separation transfer unit and a transfer image formation unit.

In the general context of positioning a ribbon for use, U.S. Pat. No. 4,558,329 issued Dec. 10, 1985 to Honda describes the use of an ink region or color panel indicator mark for each color panel, specifically in marker blocks formed on the base material of the ribbon. In the prior art, one set of marks on one side of the ribbon was used to identify the start of each color group, e.g., a grouping of yellow, magenta, cyan and black panels, and another set of marks on the opposite side of the ribbon marked each individual panel within such panel groups. Such marks were formed in a separate manufacturing process and entailed the deposition, e.g., of carbon film that was detectable by its shielding of an incident infrared diode from a photodetector. In the Honda '329 patent, a material (e.g., an inorganic salt) that will provide the desired absorption of infrared light but is heat stable and thus will not be transferred from the ribbon during the thermal printing process is included in the ink or dye formulation, and such marks are formed in the same ribbon manufacturing process as that which deposits the ink or dye onto the ribbon.

U.S. Pat. No. 4,893,951 issued Jan. 16, 1990 to Iwatani et al. describes means for avoiding the repetitive use of marker blocks for each color panel and the consequent use of substantial amounts of ribbon material therefor, specifically by marking only each sequence of color panels (conventionally, yellow, magenta, cyan and perhaps black in equal-sized panels) instead of marking the individual color panels. The amount of ribbon feed following identification of a new panel sequence is then monitored by counting pulses generated from the ribbon supply or take-up reel in order to permit calculation, after printing in one color, of the start of the next panel, to which the ribbon can then be moved. Alternatively, the Iwatani et al. device also establishes known distances between panel sequences and similarly positions the ribbon based upon calculations from an initially located panel sequence. To do so, the known distance between panel sequences is correlated with the pulse count from the pulse generator to obtain a rotary pulse count-to-linear distance relationship that is used to locate each panel sequence. Printing is carried out in cycles corresponding to such panel sequences and providing full color image printing for one sheet of substrate—i.e., so as to make one full color copy of the desired image.

A source of inaccuracy in the aforesaid procedure is that since the amount of ribbon on the take-up reel will continually increase, so as to yield an increasing cross-sectional diameter, the actual rotary pulse count-to-linear distance relationship is constantly varying, which means that (1) it must be redetermined for each panel sequence; and (2) even as to one panel sequence, the value so determined at best represents an average of such relationship over the length of the particular panel sequence on which the relationship is being measured. What is thus needed in this context is a means for determining color panel positioning that relies upon the linear relationships of the color ribbon itself, and not upon indirect and inaccurate values determined from reel rotational data.

In the multipanel devices previously set forth, each of the panels of the respective transfer media has been of the same size. U.S. Pat. No. 4,638,330 issued Jan. 20, 1987 to Watanabe describes an image forming apparatus and transfer medium in which at least one panel or region is larger than the others. Thus, the color panels may be of letter size, on the assumption that color images are more often placed on letter size than legal size paper, whereas the black panel is of legal size on the assumption that text is more often placed on legal size paper, or other choices can also be established. In any case, ink transfer is commenced at or near a leading edge of both each color (or black) panel and the particular size paper being used, and actual ink transfer is controlled by color or black signals being sent to the thermal head in the usual manner. As in the multipanel ribbons previously noted, however, it remains that the panel sizes are established so as to match one or the other size of paper onto which an image is to be transferred.

In the context of impact printers such as an ordinary typewriter, and particularly with respect to various single- or multistrike film or fabric ribbons, or ribbons having black and colored inks distributed in longitudinally separate sections thereon, including a black section and additional sections, e.g., of red, yellow, blue or green ink, U.S. Pat. No. 4,797,016 issued Jan. 10, 1989 to Lahr describes a method of encoding such ribbons with machine-readable information concerning the ribbon type (film or fabric, single- or multistrike, and what ink colors are available on the ribbon) as well as the particular longitudinal position along the ribbon that at the moment is adjacent the printing mechanism, together with information concerning the length of ribbon that remains unused. The ribbon type and remaining ribbon information is distributed along the ribbon so that it can be read by an operator at any time in the course of using the ribbon, thereby avoiding misapplication of an inappropriate ribbon type or initiation of a printing job for which insufficient ribbon is available, and the ink type information is also immediately available so that an operator can confirm whether the ribbon provides the desired color of ink. The information of the various types is printed onto the back (non-printing) side of the ribbon in standard bar code at the time of ribbon manufacture, for which ordinary, magnetic, or fluorescent ink may be used in conformity with the type of code reader to be placed on the printer.

(A method of thermally printing such bar codes onto a perforated record medium so as to provide bar code sticker labels is disclosed in U.S. Pat. No. 3,726,212 issued Apr. 10, 1973 to Combs. However, unless such printing is done in an area on the ribbon that is not further accessible to a thermal print head, to print such codes thermally onto a ribbon that itself acts as an ink or dye source, and thus is to be subjected to a thermal print head, introduces the possibility of remelting those bar codes and rendering them unreadable in the course of using the ribbon.)

The ribbon type information just discussed can also be placed at the leader end of the ribbon to be read by the printer and stored in memory at the time of ribbon installation, so that any discrepancy between such stored information (which may have been used to make adjustments to the printer) and that being read along the length of the ribbon will indicate that a ribbon has been replaced (so the printer may no longer be appropriately adjusted). A disadvantage of the Lahr method is that the parallel lines or bars which together make up the bar code are oriented transversely to the longitudinal dimension of the ribbon, hence the bars themselves are distributed longitudinally along the ribbon, so that an entire bar code group (e.g., fifteen positions) extends some distance (e.g., 3 inches) along the ribbon, and the ribbon must be moved at least that distance in order to fully read the code. (The orientation of the bar code groups appears not to have been considered in the Watanabe et al. '236 patent noted above.)

The encoding of ribbon type information, including a ribbon having a single long panel, e.g., of black, is further described in U.S. Pat. No. 4,910,533 issued Mar. 20, 1990 to Sasaki et al. Such information is provided to the printer at the time the ribbon is loaded. The ribbon type information is encoded onto either or both of two ribbon core members which act as supply and take-up rolls for the ribbon, the means of such encoding being, e.g., a layer of paint of a particular color, a knurled surface area, splined grooves, or some combination thereof. Optical sensors (i.e., a combined light emitter and detector) on the printer interpret the code so provided, whereupon the printer selects a mode of operation that will ensure proper use of the ribbon type so identified. It is also noted, however, that the ribbon type code may instead be placed on the side marginal area of the ribbon itself.

A use of position coding in the context of multi-color thermal printing similar to that of the Lahr '016 patent is found in U.S. Pat. No. 5,073,053 issued Dec. 17, 1991 to Kashiwagi. However, in this case the position discrimination marks employed are not bar codes but single lines of two different lengths oriented along one edge of the ribbon within each of the equal-sized color panels of the ribbon. Two optical sensors are positioned over the ribbon path at that same edge, and in a straight line along the long ribbon dimension, such that in passing the position discrimination marks under those sensors as the ribbon is moved forward, when a mark is read by both sensors in succession, depending upon the length of the mark the two optical sensors will or will not detect changes (high to low, low to high, or high to high) in the light reflected from those position discrimination marks, thereby identifying the particular color panel as yellow, magenta, or cyan, respectively. Disadvantages of this procedure lie in the fact that the ribbon must be traversed the full distance between the optical sensors in order to identify the panel, and placement of the position discrimination marks within the ink panel appears to render the portion so marked unuseable.

To indicate the prior art in general, FIG. 1A is a plan view of a ribbon 10*a* having disposed on one side thereof a multiplicity of panels to which heat can be applied to cause the transfer of ink or dye therefrom to a substrate to form an image. Ribbon 10*a* includes ink or dye panels of three different color types: a first color panel 12*a* of a first color (e.g., yellow); a second color panel 14*a* of a second color (e.g., magenta); and a third color panel 16*a* of a third color (e.g., cyan). Each of color panels 12*a*–16*a* has a dimension in the longitudinal direction of ribbon 10*a* equal to the length or width of a common paper size, e.g., 11 inches, and has a transverse dimension equal to the width or length of that paper size, e.g., 8½ inches. Of course, the color panels of ribbon 10*a* can also be formed in other paper sizes such as A4 (210 mm×297 mm), etc. In use, ribbon 10*a* is attached at each end thereof to rollers (not shown) which serve to move ribbon 10*a* in the direction of arrow 18*a* such that selected ones of color panels 12*a*–16*a*, in a predetermined sequence, can be placed adjacent to a printing head (not shown) so as to permit the transfer from each selected color panel of ink or dye of the color that characterizes that color panel. It is possible to obtain a black image from superposition of the yellow, magenta and cyan colors, but the quality of such an image is low, and of course the need to conduct three image transfers is time consuming.

Ribbon 10*a* also includes a border 20*a* (the width of which, and of the analogous borders 20*b* and 20*c* in FIGS. 1*b* and 1*c* are exaggerated for purposes of clarity) along one longitudinal side thereof within which, near the leading (as shown by arrow 18*a*) edge of each color panel, are placed indicating marks which serve to establish the start of each color panel. External sensors (not shown) are used to detect a double marker 22*a* disposed near the leading edge of first color panel 12*a* to indicate the start of panel 12*a* (yellow); a first single marker 24*a* disposed near the leading edge of second color panel 14*a* to indicate the start of panel 14*a* (magenta); and finally a second single marker 26*a* disposed near the leading edge of third color panel 16*a* to indicate the start of panel 16*a* (cyan). An example of this type of apparatus may be seen in the Tektronix Phaser II thermal transfer printer.

FIG. 1B shows a ribbon structure analogous to that of FIG. 1A but which also includes a black panel to allow production of a higher quality black image. Specifically, ribbon 10*b* has disposed thereon, in a manner similar to ribbon 10*a*, a first color (yellow) panel 12*b*; a second color (magenta) panel 14*b*; a third color (cyan) panel 16*b*; and a fourth color (black) panel 17*b*. Arrow 18*b*, border 20*b*, double marker 22*b*, first single marker 24*b* and second single marker 26*b* are disposed as and serve analogous functions to the corresponding elements of FIG. 1A. Ribbon 10*b* also includes a third single marker 28*b* disposed near the leading edge of and serving to identify the start of black panel 17*b*.

FIG. 1C shows a ribbon 10*c* similar to ribbon 10*a* shown in FIG. 1A except that the three color panels on ribbon 10*c* are not contiguous. (A similar structure that included a black panel as in FIG. 1B could of course be drawn as well.) That is, the analogous yellow panel 12*c*, magenta panel 14*c*, and cyan panel 16*c* are separated by a first space 30*c* between yellow panel 12*c* and magenta panel 14*c*; a second space 32*c* between magenta panel 14*c* and cyan panel 16*c*; and a third space 34*c* between cyan panel 16*c* and yellow panel 12*c*. FIG. 1C includes an arrow 18*c* to show the direction of ribbon flow, but ribbon 10*c* may or may not include a border 20*c*, as shown by the dashed lines of FIG. 1C. (Typically, ribbon 10*c* would not include such a border, since it is the purpose of spaces 30*c*–34*c* to eliminate the need therefor, thereby permitting each color panel to extend the full width of the ribbon as shown.) Also, ribbon 10*c* does not include the same double and single markers as do ribbons 10*a* or 10*b* since it is the specific purpose of spaces 30*c*–34*c* to provide different locations for indicating not only the leading edges of the various panels but also their colors. Instead, ribbon 10*c* includes a first code mark 36*c* in first space 30*c* to indicate the start of yellow panel 12*c*, including the color thereof; a second code mark 38*c* in second space 32*c* to indicate the start of magenta panel 14*c*, as well as the color thereof; and a third code mark 40*c* in third space 34*c* to indicate the start of and color of cyan panel 16*c*. Code marks 36*c*–40*c* may consist of bar code as in the Watanabe et al. '236 patent, an aperture as in the Iwatani et al. '951 patent, or of infrared-absorbing or reflective material as in the Honda '329 patent.

With respect to the apparatus that will employ ribbons such as ribbons 10*a*–10*c*, it is known in the art to incorporate within the apparatus certain mechanical, magnetic, electronic or optical sensors that determine what type of ribbon roll has been installed, including the type of ribbon and the size, colors, repeat sequences and numbers of different panel types thereon, as well as such operating parameters as heating requirements and optimum print head pressures. The particular sensor type used may respond, e.g., to the diameter of the ribbon roll markings on the ribbon cassette, ribbon rolls or in the ribbon fields, bar codes on the ribbon shaft, and the like. Such information may be included or repeated by markings that identify each color panel. Upon identification by such means of the type of roll that has been installed, and within a range of types (typically about six types) that a particular printer can accommodate and for which it has been pre-programmed, a printer control board within the printer employs information previously stored in ROM or installed as "firmware" and corresponding to the roll type so identified to control the use of the particular ribbon. However, except by the limited means previously noted from the Watanabe et al. '236 patent and pertaining to panel halves only, or similarly from the Ohshima '247 patent, what has not been provided is any means for determining and recording, in the course of using a particular ribbon, which panels or portions thereof have been used.

A common feature of the aforesaid prior art, commencing with Seto et al. ('095), is that the various color panels are specifically sized to correspond to the sizes of the paper onto which an image is to be transferred. Watanabe et al. ('236) describes an image forming apparatus and transfer medium in which at least one panel or region is larger than the others, but still the sizes indicated are such as to conform, e.g., to A4 and A5 paper, in which one paper size is exactly twice that of the other, or nearly so Secondly, color selection in the prior art often rests either entirely or in part upon the use of a transfer medium in which the specific order of colors in the various color panels is fixed and known, so that at least one of the color panels (typically, two or three out of a set of three or four) can only be selected on the basis of that order. Also, except for Tanaka ('615), the application of which is limited to the thermal transfer of a white or transparent ink layer onto a substrate, the art has not provided means or apparatus for economically printing other than standard black and white or multicolor images without excess wastage of ribbon. Many printing applications require the ability, e.g., to carry out highlighting, i.e., the application of additional single color overprinting for emphasis on an existing color or black and white print, and it is not economical to use ribbons designed for full color printing for that more limited purpose.

Perhaps the major consequence of these limitations in the prior art, however, is that printing tasks exist in a very wide variety—some black and white, some two-color, some three-color but in which one of the colors may be used only slightly, etc. For many of these tasks the limited variety of ribbons available, together with the inability of existing apparatus to employ other ribbon types even if they were available, causes an inordinate waste of ribbon. Such waste arises from the inability to adjust the size of a color panel to the amount of printing that a task is expected to require, to obtain and maintain any record of what portions of any particular ribbon or ribbon panel have been used, or indeed to scan any such record even if it did exist and thus to permit rotation of the ribbon roll so that unused portions even within a single panel could be moved to the location of the print head for use. What is needed and would be useful, therefore, is a type of transfer medium in which the relative sizes and order of the respective color panels, and indeed of a wide variety of different panel types, can be pre-established at will, and also an image forming apparatus that is capable of accepting one or the other of a variety of such transfer media, and then employing the panels of such a medium, and portions thereof, in any desired order. The summary which follows describes further advantages exhibited by the invention in its several aspects.

TERMINOLOGY

The invention in its several aspects encompasses a wide range of applications, for which the use of particular terminology seems appropriate. When used hereinafter, therefore, the following terms will have the meanings as shown unless otherwise stated:

Energy Source: A source of a form of energy (light or heat) including a laser, a conventional thermal transfer print head, and the like.

Transfer material: A substance placed on a medium for the purpose of being transferred therefrom to a substrate by the application thereto of one or more forms of energy in order to form an image on the substrate.

Printer: An apparatus that employs an energy source to apply one or more forms of energy to a transfer material in order to form an image on a substrate, including a printer, a FAX, the printing portion of a copier, or the printing portion of any other like device that functions as stated.

Technology: A particular method of transferring an image from a medium to a substrate using one or more forms of energy, including those in which the transfer material comprises thermal transfer ink, dye diffusion dye, electroresistive ink, combinations of chromogenic materials and encapsulated radiation curable compositions, combinations of a developer and a photosensitive microencapsulated material, materials subject to transfer when acted upon by light (including laser light), and materials in which either or both light and heat cause changes in at least one of the group of physical parameters of said materials consisting of softening, melting and glass transition temperatures, rates of sublimation and of diffusion, and viscosity, as well as other methods and materials whether or not presently known or conceived.

Type: Variations in method within a particular technology, such as the use of different thermal transfer materials that require different temperatures or the like for transfer to occur.

Class: A subset of transfer materials within a particular technology, e.g., precoat, overcoat and colored ink comprise three classes of thermal transfer materials (of the same or different types).

Panel: A single continuous region on a medium that has had a single class of transfer material, and in a single color (where applicable), applied thereon.

Set: A collection of one or more panels that are contiguous (or nearly so) and fall within a particular class, e.g., a set of yellow, magenta and cyan (y, m, c) color thermal transfer panels.

Group: A collection of panels, or sets of panels, that fall within a single technology, e.g., a set of y, m, c panels, a black panel, and one or more panels of clearcoat or overcoat that all transfer by means of a single type of thermal transfer.

The invention relates to methods and apparatus by which the various technologies by which printing can be carried out can be exploited to greater advantage, but does not relate directly to any such technologies in and of themselves; therefore, it is to be understood that in what follows it is the intention to apply the invention to all of the technologies defined above, whether or not that may be explicitly stated and even if a particular discussion may be given in terms of some particular technology, which in each case will be meant to be exemplary only, and not exclusive.

SUMMARY OF THE INVENTION

In a first aspect, the invention comprises a general purpose printing ribbon of thermal transfer, dye diffusion ("dye sublimation") or other technology, the action of which depends upon the application thereto of one or more forms of energy such as heat, or both light and heat, so as to bring about the transfer therefrom of ink, dye, coating or any other transfer material onto a substrate. The ribbon is characterized by the fact that it can be bulk manufactured, or custom fabricated by joining panels, in a wide variety of forms in terms of the technologies, sizes, and order of the panels contained within a single ribbon.

In a second aspect, the invention comprises apparatus capable of accommodating such ribbons in all such forms, and of using such ribbons in a way that the desired image will be transferred, the speed of printing is maximized, while at the same time the amount of ribbon, ribbon panels or portions thereof that are wasted is minimized. The invention accomplishes these purposes in the ribbon through a substantially more thorough use of identification markings as to the nature of each ribbon, the individual panels and portions thereof, and detailed characteristics of the variety of panels that the ribbon may contain. Such markings may be disposed in regions of the ribbon reserved for that purpose, or may be within the same ribbon area as the panels of transfer material so as to maximize the amount of usable panel space on the ribbon. In the apparatus, these purposes are accomplished by means which provide a map of ribbon usage that is placed in memory within the printer and either additionally or alternatively on the ribbon cassette itself, so that the information is not lost upon changing ribbons.

BRIEF DESCRIPTION OF THE DRAWINGS

The preferred embodiments of the invention will now be described in detail with reference to the accompanying drawings, in which.

FIGS, 12A and 12B show in block diagram an apparatus and circuitry for making a correlated record of energy source and ribbon positions and hence a ribbon use map, together with a tape cassette with installed memory chip and cable for preserving ribbon usage data with the ribbon.

DETAILED DESCRIPTION OF THE INVENTION

RIBBONS

Figure 2A:
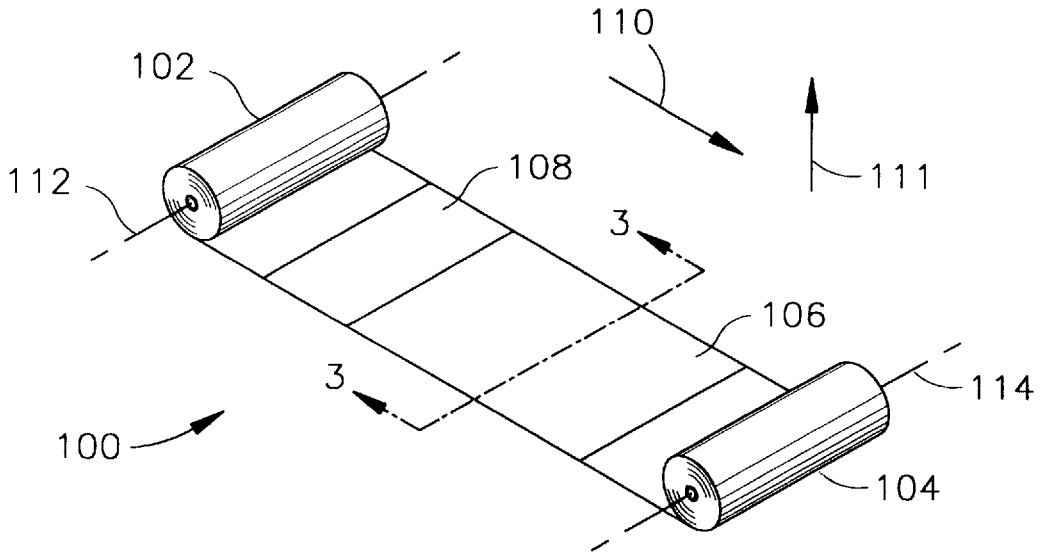
FIG. 2A shows in perspective a first embodiment of one aspect of the invention, consisting of a combination transfer ribbon having color panels of different lengths.
Figure 2B:
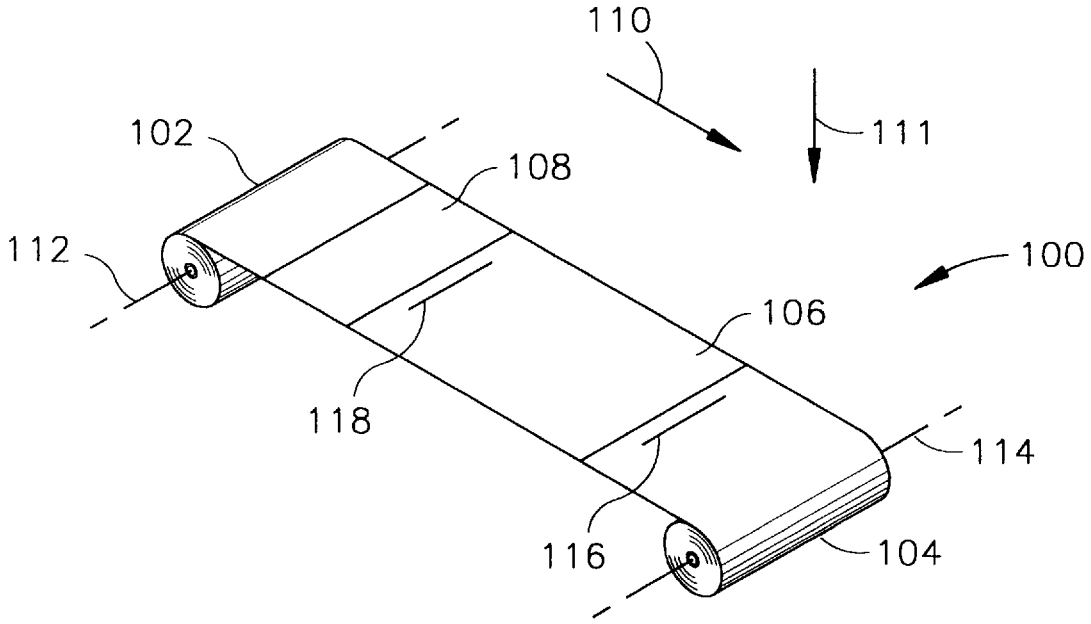
FIG. 2B shows the reverse side of the transfer ribbon of FIG. 2A, including panel marking areas.

Referring now to the several figures in which like elements are numbered similarly throughout, FIG. 2A shows in perspective view a ribbon 100 disposed on a supply roll 102 and extending to a take-up roll 104. Although not shown in the figure, supply roll 102 and take-up roll 104 may be disposed within a ribbon cassette in the usual fashion. Ribbon 100 includes on one side thereof (visible in FIG. 2A) a first color panel 106, and also a second color panel 108. To illustrate one principle of the invention, first color panel 106 has an arbitrarily longer dimension along the length of ribbon 100 than does second color panel 108. In the course of use, ribbon 100 is moved from supply roll 102 to take-up roll 104, in the direction of arrow 110, by counterclockwise (in FIG. 2A) rotation of rolls 102, 104 about their respective axes 112, 114. Arrow 111 in each of FIGS. 2A–2E shows the direction through ribbon 100 towards the "ink side," by which is meant the side of ribbon 100 on which the several color panels have been placed. (Thus, in FIG. 2A the ink side is visible, while FIG. 2B shows the reverse of the view in FIG. 2A, hence the ink side is the "under" side in FIG. 2B and is not visible.)

In one example of ribbon 100, first color panel 106 may be black, as for printing text, and second color panel 108 may be blue, or some other color such as red, that would be used to "highlight" or overprint selected portions of the text. The relative longitudinal dimensions of first and second color panels 106, 108 can be pre-established at the time of manufacture in anticipation of the relative amount of highlighting expected to be required in using such a ribbon. Alternatively, first color panel 106 can be a special one-time print black ribbon for a special coated substrate, and second color panel 108 may be a multiprint black ribbon that can be used economically for character printing. As a third example, first color panel 106 may be of clear ink to provide a clear precoat layer on plain paper prior to the use of a black or colored ink in second color panel 108. In each such example, and in other examples to be described below, in other words, a ribbon may be employed that has been specifically designed or selected to carry out some particular printing task.

The ability to employ ribbon 100, in which again the relative lengths of first color panel 106 and second color panel 108 can have various values, depends firstly upon the ability to determine the "boundary" point along ribbon 100 at which first color panel 106 terminates and second color panel 108 begins. Unlike much of the prior art, which often merely identifies the leading edge of a color panel and then depends for control of the printing operation on the fact that the color panels are of known size, either equal or one is a multiple of the other (or nearly so) as in the Watanabe et al. '236 patent, the invention reflects another part of the prior art by providing means, i.e., individual panel markings, for determining the location of the boundary between color panels wherever that boundary may happen to appear along the length of ribbon 100. Thus, it is known, for example, to provide tables (in firmware within the printer) that specify such structural details of various ribbon types, and upon loading a ribbon of a particular type, as so identified by code markings thereon, the appropriate one of such tables is then used to aid in subsequent use of the ribbon.

Secondly, the ability to employ ribbon 100 most advantageously depends upon the ability to ascertain the size of a particular panel by one of the other of the aforesaid means, and also at what position along the length of the panel that the energy source happens to be located at a particular moment, in order for it to be known whether or not an intended printing operation can be carried out. (The remaining unused portion of a panel might be smaller than the size of paper for the next intended print operation.) The size of a panel might be found by determining the positions of its leading and trailing edges, the latter perhaps merely being the leading edge of the subsequent panel, or such information may in any case have been pre-established within the printer through identification of the kind of ribbon that has been installed in the manner just discussed. Determination of the location along the ribbon that at the moment lies under the energy source, on the other hand, requires additional means that will be described below.

Figure 1A:
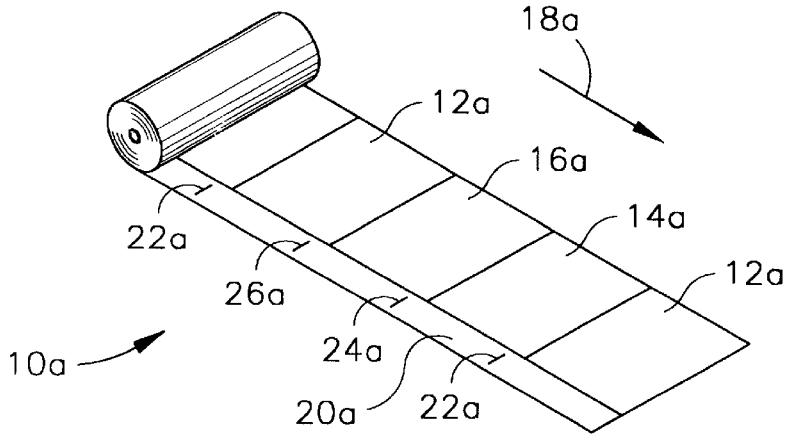
FIG. 1A Prior Art
FIG. 1A shows a three-color thermal transfer ribbon from the prior art.
Figure 1B:
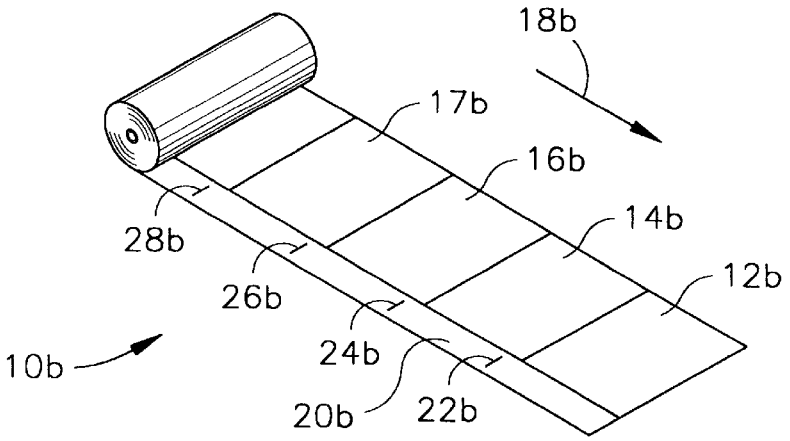
FIG. 1B Prior Art
FIG. 1B shows an alternative thermal transfer ribbon from the prior art that includes a black panel.
Figure 1C:
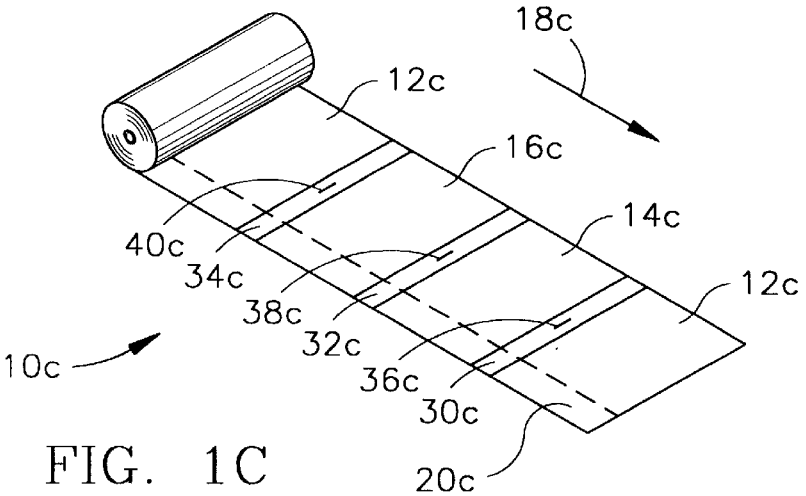
FIG. 1C Prior Art
FIG. 1C shows another alternative thermal transfer ribbon from the prior art that includes spaced-apart color panels.

To illustrate means for determining the location of the boundary between two panels, FIG. 2B provides another perspective view of ribbon 100 but, as shown by arrow 111, from a reverse perspective so as to expose the "under side" of ribbon 100 as the same is shown in FIG. 2A. In the prior art shown in FIGS. 1A–1C, markers 22*a*–26*a* and 22*b*–28*b* were located along an edge of ribbons 10*a*–10*a*, respectively, and markers 36*c*–40*c* were located within spaces 30*c*–34*c* disposed between color panels 12*c*–16*c*. In that art, some region or regions of the ribbon were left outside the boundaries of the color panels in order to accommodate those markers, and hence such regions were not available for the transfer of ink. Thus, in the examples of FIGS. 1A–1B, it is necessary to employ a ribbon that is wider than the color panels to be printed so as to include the border 20*a*–20*b*, while in the example of FIG. 1C, the ribbon must be longer than is required for the color panels alone in order to accommodate the spaces 30*c*–34*c*. In either case, a part of the ribbon is wasted in the sense that it is not available for printing. In FIG. 2B, on the other hand, it is shown by arrow 111 that first marker 116 and second marker 118 are positioned on the side of ribbon 100 opposite that which holds the color panels. As shown in all of FIGS. 2A–2E, indeed, by this concept the entirety of the "ink side" of ribbon 100 can be seen to have been made available for printing. Although other aspects of the invention as will be discussed below may also be accomplished using markings that appear outside of the various color panels, one aspect of the invention lies in the adopted means, to be discussed below, that additionally permit use of the area within the various panels for such purposes. The more or less central positions in the transverse direction of first and second markers 116, 118 as shown in FIGS. 2B–2E should thus be understood to be exemplary only, in that such positioning may occur anywhere along a transverse line across ribbon 100 and still remain within the scope of the invention. Of course, the sensor, as a part of the printer that is to employ ribbon 100, and that is to interpret markers 116, 118 and the like, must be located in a corresponding position in order that markers 116, 118 and the like can be read and interpreted.

Figure 2C:
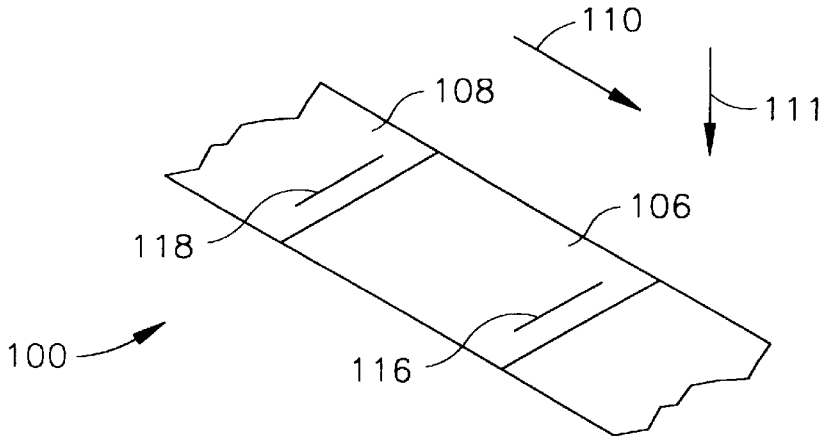
FIGS. 2C–2E show alternative locations for placement of the panel marking areas of FIG. 2B.

Concerning the longitudinal positioning of markers 116, 118, while the precise positioning relative to the boundaries between color panels will be discussed below, it may be noticed at the moment that in comparing FIGS. 2B and 2C, both of which are shown by arrows 111 to represent a side of ribbon 100 opposite the ink side, in FIG. 2B first marker 116 is to the right or "forward" (in terms of direction arrow 110) of the leading edge of color panel 106, and second marker 118 is similarly located with respect to the leading edge of color panel 108, whereas in FIG. 2C, first marker 116 is to the left or "backward" of the leading edge of color panel 106, and second marker 118 is again similarly located with respect to the leading edge of color panel 108. From the examples of FIGS. 22 and 2C, for which it may now be noted that first marker 116 contains information identifying first color panel 106 and similarly second marker 118 contains information identifying second color panel 108, it should be clear that in a longitudinal sense, markers 116 or 118 can be placed either prior to the color panel that each is to identify, or within that color panel. The manner of using one or the other of those two embodiments will be discussed further below, since at the moment it is necessary to point out another means for using markers 116, 118 in a manner that will preserve the entirety of one side of ribbon 100 for printing purposes. That means is illustrated in FIGS. 2D and 2E.

Figure 2D:
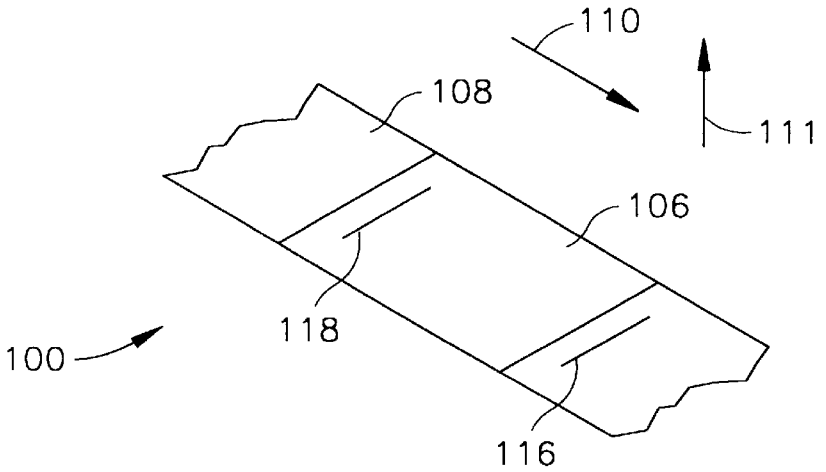
Figure 2E:
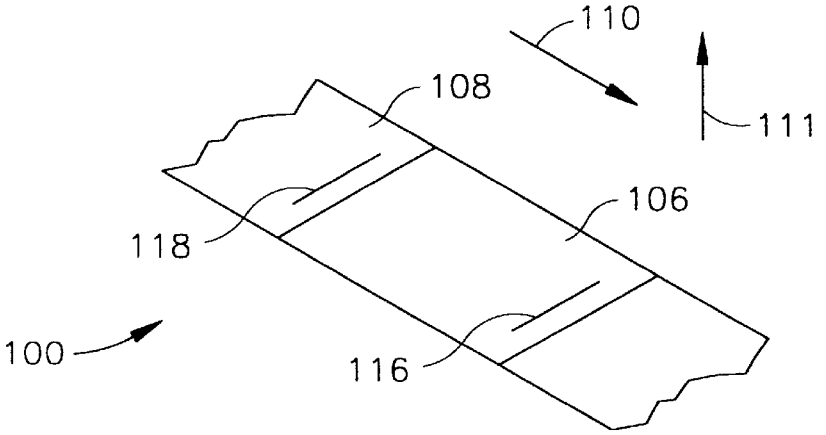

Specifically, arrows 111 in FIGS. 2D and 2E indicate that in both cases it is the ink side of ribbon 100 that is visible. The depiction of first and second markers 116, 118 in FIGS. 2D and 2E thus means that first and second markers 116, 118 are placed on the same side of panel 100 as color panels 106, 108, i.e., on the "ink side," and within the boundaries thereof. Similarly to the embodiments of FIGS. 2B and 2C, in FIG. 2D first and second markers 116, 118 are placed forward of the boundaries of color panels 106, 108 that first and second markers 116, 118 respectively identify, and in FIG. 2E first and second markers 116, 118 are placed longitudinally after the boundaries of color panels 106, 108 that first and second markers 116, 118 respectively identify. The new principle of the invention to be noted from FIGS. 2D and 2E is that it is possible to place various markers on a ribbon on the same side thereof as the color panels are placed without interfering with the function of those color panels. The manner of so doing rests on the fact that in order for such color panels to carry out their own multicolor image transfer process, the transfer material that makes up such color panels must be transparent to some extent in any event—otherwise the only color that would be visible in an image so transferred would be that of the last color. Thus, in the course of manufacture of ribbon 100, first and second markers 116, 118 (and, of course, all other such markers) are placed on the ribbon prior to placement thereon of color panels 106, 108. Since the transfer material making up color panels 106, 108 is functionally transparent, first and second markers 116, 118 can be interpreted by light sensors that effectively "see" through color panels 106, 108. In printing first and second markers 116, 118 and the like it may also be preferable to employ reflective paint for greater ease of detection through the transfer material of the color panel.

In an alternative embodiment, suitable for printing with transfer materials that are not transparent, if the method of marking is based upon deposition of a magnetic material, the embodiments of ribbon 100 shown in FIGS. 2D–2E, in which again the markers are placed on the same side of the ribbon substrate as the color panels, can still be used since interpretation of such markers rests upon magnetic and not light sensing. Placement of first and second markers 116, 118 and the like on the same side of the ribbon as the ink panels also avoids possible interference of such markers with any lubrication layer that may have been used on the opposite side thereof, when required, to decrease the friction between ribbon 100 and a print head.

The actual construction of ribbon 100 embodiments that place markers both on the same side of the ribbon substrate as the color panels and on the opposite side is shown in FIG. 3. FIG. 3A shows a cross-sectional view (through the line 3—3' of FIG. 2A) of the embodiment of ribbon 100 shown in FIG. 2A (and in FIG. 2B) such that color panel 106 is shown to be disposed above the ribbon material, and second marker 118 is located on the opposite or "underneath" side of the ribbon material. FIG. 3B, on the other hand, illustrates in an analogous cross sectional view the alternate embodiment of ribbon 100 in which second marker 118 is on the same side of the ribbon substrate as color panel 106, and indeed lies between the ribbon substrate and color panel 106. This latter construction maintains its utility for optically readable markers when using transparent transfer materials since light passes through the color panels, while this construction functions for magnetic markers even if the color panels are not transparent.

Figure 3A:
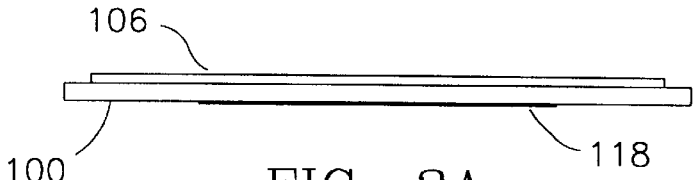
FIGS. 3A and 3B show perspective cross-sections, in vertically exaggerated form, of the transfer ribbon of FIG. 2*a* taken along the line 3—3'.
Figure 3B:
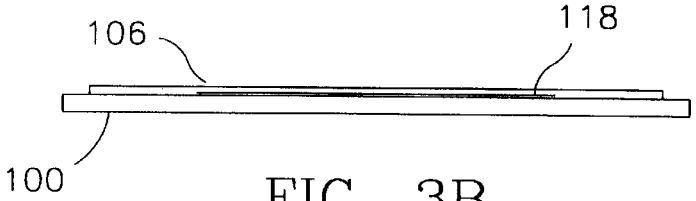
Figure 3C:
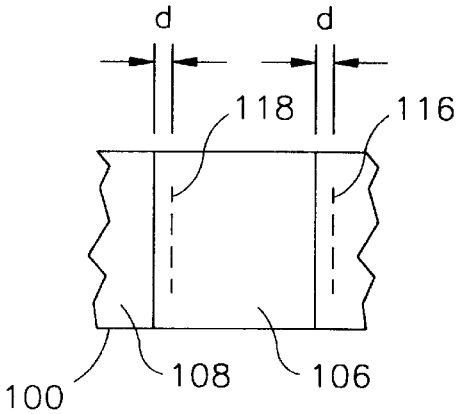
FIGS. 3C–3F show top plan views of the panel markings of FIGS. 2*b*–2*e*.
Figure 3D:
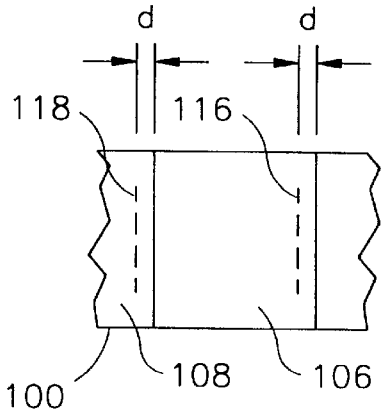
Figure 3E:
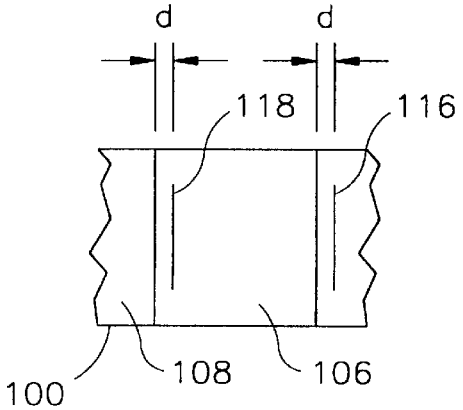
Figure 3F:
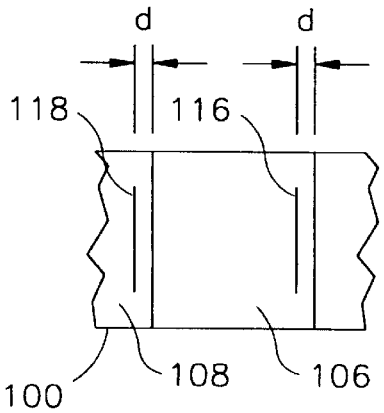

With regard to the alternative placements of first and second markers 116, 118, these can perhaps best be seen in FIGS. 3C–3F, which are top plan views (looking at the "ink side" of the ribbon) of the panel markings of FIGS. 2B–2E. Thus, in FIGS. 3C and 3D, first and second markers 116, 118 are shown by dashed lines, which means that first and second markers 116, 118 are located on the under side of ribbon 100 as in FIGS. 2B, 2C and 3A. The distinction between FIGS. 3C and 3D is that in the former case, first and second markers 116, 118 are located forward of the boundaries of panels 106, 108 that they respectively identify, as in FIG. 2B, whereas in the latter case first and second markers 116, 118 are located after the boundaries of panels 106, 108, as in FIG. 2C. Similarly, in FIGS. 3E and 3F, first and second markers 116, 118 are shown by solid lines, meaning that first and second markers 116, 118 are located on the visible "ink side" of ribbon 100 as in FIGS. 2D, 2E and 3B. In the same manner as before, FIGS. 3E and 3F are distinguishable by the fact that in FIG. 3E, first and second markers 116, 118 are located forward of the boundaries of color panels 106, 108 that they respectively identify, and in FIG. 3F, first and second markers 116, 118 are located after the boundaries of (i.e., within) color panels 116, 118.

FIGS. 3C–3F also illustrate the fact that in the manufacture of ribbon 100, it is advantageous to place markers 116, 118 and the like, regardless of whether such markers are to appear on the "ink side" of ribbon 100 or on the opposite side, and also whether such markers are to appear before or after the boundary of the color panel which each is to identify, some predetermined and fixed distance d from the appropriate boundary. The reason for so doing is that it is one purpose of such markers to establish the locations of such boundaries, and rather than placing such markers right on such boundaries it is preferable to place them a fixed distance therefrom, wherein that distance d may correspond to the distance on the printer between the longitudinal position of marker sensor 120 and that of energy source 122. More generally, since it is the function of markers 116, 118 and the like merely to aid in positioning ribbon 100 so that energy source 122 becomes disposed for use "over" some selected ink panel, it is not necessary that marker sensor 120 be located exactly the same distance d from panel boundary 124 as separates marker sensor 120 and energy source 122, but only such distance as will indeed so place ribbon 100 relative to energy source 122. Such a distance may be established by the actual physical location of marker sensor 120 relative to energy source 122, or by providing some predetermined delay in printing through the counting of motor drive pulses, such that printing does not commence until the ribbon has been advanced some fixed distance after the marker sensor has detected markers 116, 118 or the like. (In ribbon manufacture, unintentional gaps may often be left between color panels, and the latter procedure provides means within the printer for avoiding the consequences of such errors, such as an attempt to print at a ribbon location outside of any panel at which no transfer material is present.)

Figure 4A:
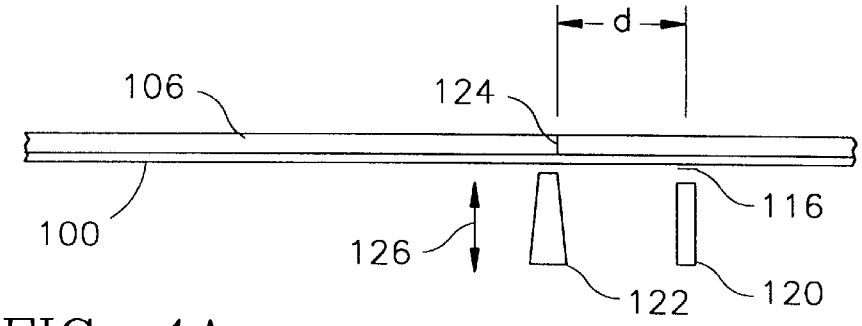
FIGS. 4A–4D show schematically, in side elevation, various placements of a print head and code reader combination corresponding to the transfer ribbon embodiments of FIGS. 2B–2E and 3C–3F.
Figure 4B:
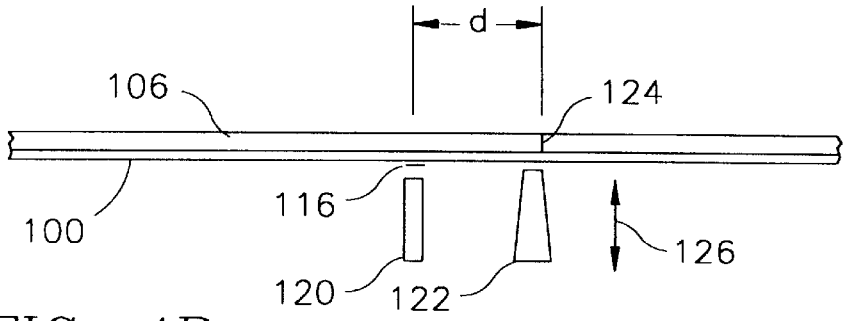
Figure 4C:
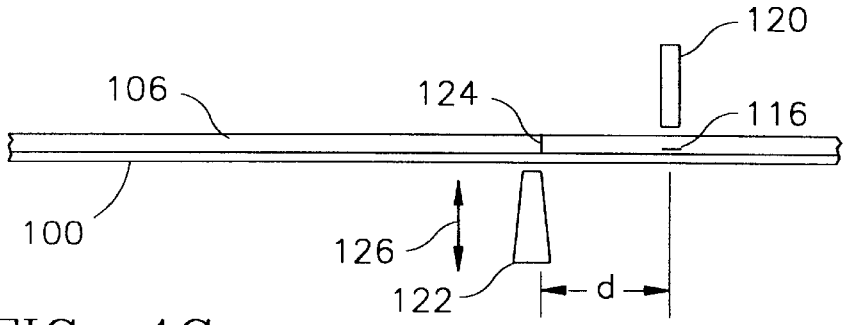

The marker sensor and energy source configurations appropriate to each of the ribbon 100 embodiments of FIGS. 3C–3F are shown in FIGS. 4A–4D. Thus, the embodiment of ribbon 100 shown in FIG. 3C implies that (1) the marker sensor is disposed on the same side of ribbon 100 as the energy source—which is to say on the side of ribbon 100 opposite the ink side; and (2) the marker sensor is located forward of the energy source, so that the detection by the marker sensor of a marker such as one of markers 116, 118 or the like will signify that at the time of such detection, the energy source is located at the boundary of the color panel that the marker in question is to identify. In FIG. 4A, therefore, first marker 116 is on the "under" side of ribbon 100 at a distance d forward of the leading edge of color panel 16 (identified as boundary 124); color panel 106 is on the upper side of ribbon 100, marker sensor 120 is "below" ribbon 100 at a distance d forward of energy source 122, which is likewise below ribbon 100 in line with boundary 124. (The significance of arrows 126 in FIGS. 4A–4D will be discussed below in connection with FIG. 6.) Similarly, in FIG. 4B, color panel 106 and energy source 122 are disposed as before, first marker 116 is on the under side of ribbon 100 but at a distance d after boundary 124, and marker sensor 120 is below ribbon 100 that same distance d forward of boundary 124. In FIG. 4C, first marker 116 is on the upper side of ribbon 100 as is color panel 106 and at a distance d forward of boundary 124, marker sensor 120 is above ribbon 100 at that same distance d forward of boundary 124, and energy source 122 is again below ribbon 100 in line with boundary 124. Finally, in FIG. 4D, color panel 106 and energy source 122 are again disposed as before, first marker 116 is again above ribbon 100 but at a distance d after boundary 124, and marker sensor 120 is above ribbon 100 that same distance d after boundary 124.

Figure 4D:
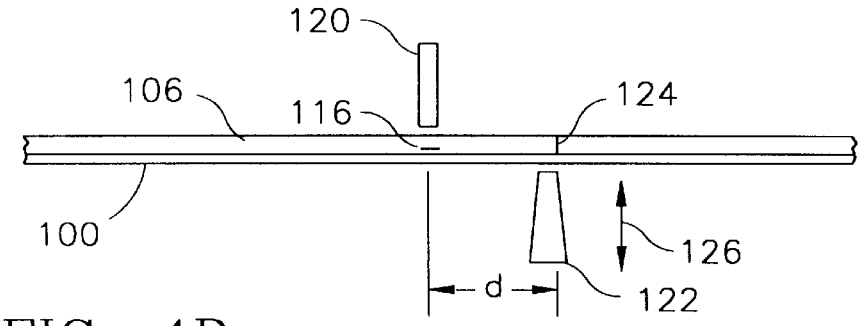

In FIGS. 4A–4D, the distance d as defined by the distance within the printer between marker sensor 120 and energy source 122 can have any practical value, as determined by other space requirements in the construction of the printer of which marker sensor 120 and energy source 122 are a part, but cannot have the value zero: in FIGS. 4A and 4B, such a value would place marker sensor 120 in the same longitudinal position as energy source 122, which cannot occur if energy source 122, as preferred, extends fully in the transverse direction across ribbon 100; and in FIGS. 4C and 4D, a value for d of zero would place marker sensor 120 in the same location along ribbon 100 as the platen (not shown) which supports ribbon 100 for the image transfer process. (It should be noted that a laser source, even though perhaps disposed some distance from ribbon 100, must still have "visible" access to ribbon 100, which cannot occur if marker sensor 120 were in the same longitudinal position.) As noted earlier, however, the distance at which the various markers are placed from (or within) the ink panels that each of them identifies need not be precisely the same as the distance which separates marker sensor 120 and energy source 122: in FIGS. 4A–4D it is apparent that first marker 116 might have been placed somewhat to the left of its indicated position (i.e., closer to boundary 124 in FIGS. 4A and 4C or farther from boundary 124 in FIGS. 4B and 4D) so as to position ribbon 100 whereby in a longitudinal sense, energy source 122 would become positioned somewhat further within panel 106 than precisely at boundary 124. And again, there also occur errors in manufacturing as a result of which not all panels are abutting so as to define a single boundary 124, i.e., there may be a space containing no transfer material in between two or more panels. In that case, unless a delay has been programmed into the printer as noted earlier, it is important that markers such as first marker 116 become placed a distance from or within the panel that it identifies that will position the panel and not such a space adjacent energy source 122.

In many kinds of printers, the embodiments of FIGS. 4A and 4B that place first marker 116 (and of course all other such markers) on a side of ribbon 100 opposite the color panels, which requires marker sensor 120 to be disposed on the side of ribbon 100 opposite from the platen (or similar device such as a drum, etc.), will constitute preferred embodiments in order to avoid interfering with that device. Except for this matter of the relative disposition of the marker sensor and the energy source so as to correspond to the various particular embodiments of ribbon 100, and except for certain additional features of the invention relating to methods for establishing the longitudinal positioning of ribbon 100 more precisely that will be discussed below, the general manner of constructing a printer that can accept and employ these various embodiments of ribbon 100 is deemed to be known to a person of ordinary skill in the art and will not be discussed further. For example, if the principles of the present invention are applied in the context of a layered transfer medium that employs both heat and light as described in the Miyagawa et al. '058 patent, e.g., to identify various ones of a plurality of transfer materials disposed on a single ribbon, a printer that uses the present invention must also include, e.g., a separation transfer unit and transfer image formation unit as there described, and similarly in the case of the transfer media also discussed therein that respond to light only. Similarly, a printer must obviously contain (or be able to be replaced with) an energy source appropriate to the technologies required for a particular kind of ribbon.

Having illustrated the principal features of the invention in terms of the foregoing examples, a number of additional embodiments of the invention that employ those principles can now be pointed out. Although the examples that follow are shown and described in terms of only one of the preceding constructions, specifically that of FIG. 4A in which the markers are placed longitudinally prior to the color panel that they identify and are placed on a side of the ribbon opposite the color panel, it will be understood that the alternative embodiments having the various different constructions as shown must also be regarded as being within the scope of the invention.

In general, on ribbons that embody the invention the length of each panel and the number of repeating units of panels can be adjusted to conform with expected customer use, and the ribbon can be manufactured in any convenient length. For general purpose printing applications, a ribbon 100 may be of a length to print anywhere from 100 to 10,000 monochrome prints, or one third of that number for three-color printing. Thus, in ribbon 100 as previously shown, first panel 106 (e.g., of black ink) might encompass 70 percent of the total ribbon length, and second color panel 108 (e.g., of blue ink) would encompass the remaining thirty percent. In a length, e.g., of 11,000 inches, the black panel might be 7,700 inches long so as to print 700 eleven-inch black images, and the blue panel 3,300 inches long so as to print 300 eleven-inch blue images.

A ribbon having such long individual panels is relatively inexpensive to produce, and is useable for low cost printing operations, but is inconvenient because of the length of time required to move the ribbon from one panel to the other, which thereby slows down the printing operation. For example, if the blue panel were needed for the next image transfer, but the ribbon was located so that the energy source was near the start of the black panel, at 20 inch/sec of ribbon movement it would take 385 seconds to wind through the 7,700 inches of black panel to arrive at the blue panel. In addition to requiring considerable time, such an operation would likely be repeated a number of times in the course of a complete printing operation, requiring the ribbon to be moved back and forth enough times to cause significant wear thereon. Consequently, to reduce both ribbon wear and such time requirements, a preferred embodiment of the invention will have repeating units of a length perhaps 20 times the length of a standard copy paper, e.g., using the same 70/30 ratio, a black panel of 154 inches and a blue panel of 66 inches yields a total unit length of 220 inches. By such a design, the worst case ribbon movement requirement (again to get from the start of the black panel to the start of the blue panel) would take only 7.7 seconds. Moreover, it would be likely that the black or blue panels within such a single repeating unit would soon be fully utilized, and would not again be traversed or sought out in moving from panel to panel (i.e., the above-stated "worst case" would not again be repeated), hence the total ribbon wear would also be minimized. Of course, such a ribbon can also be made in a form in which the long dimension (11 inches) of 8½ by 11 inch paper is disposed transverse to the ribbon, which would require a wider ribbon (and energy source), but which would be shorter for a given number of copy requirements and could also be traversed more rapidly from panel to panel.

From the foregoing discussion, it is now useful to set forth more completely precisely what information is contained within a marker, e.g., as in first marker 106 and second marker 108. In addition to identifying the color of the panel that the marker identifies, for ribbons on which the color panels appear in repeating units, such markers also include a number identifying which particular repeating unit the energy source is within. The repeating units can be numbered sequentially from the start of the ribbon, i.e., the first unit is "1," the second is "2," and so on. By that means, it becomes possible to move just one, or at worst just several repeating units, to come upon a color panel of the desired color, and traversal of extensive portions of the ribbon for such purpose is avoided.

At the same time, for economic reasons it may be the practice to manufacture such a ribbon in lengths far in excess of that to be installed at one time into a printer, and then to cut such a ribbon into those smaller useable portions. In that case, if in the ribbon manufacturing process the sequence of numbers used to mark the various panels (or sets thereof, etc.) had been continued throughout, such a smaller ribbon portion would commence with a number other than one. For that reason, the printer includes means for taking account of that actual starting number accordingly. (Other information contained within each marker, for purposes of controlling ribbon use, will be described below.)

Figure 5A:
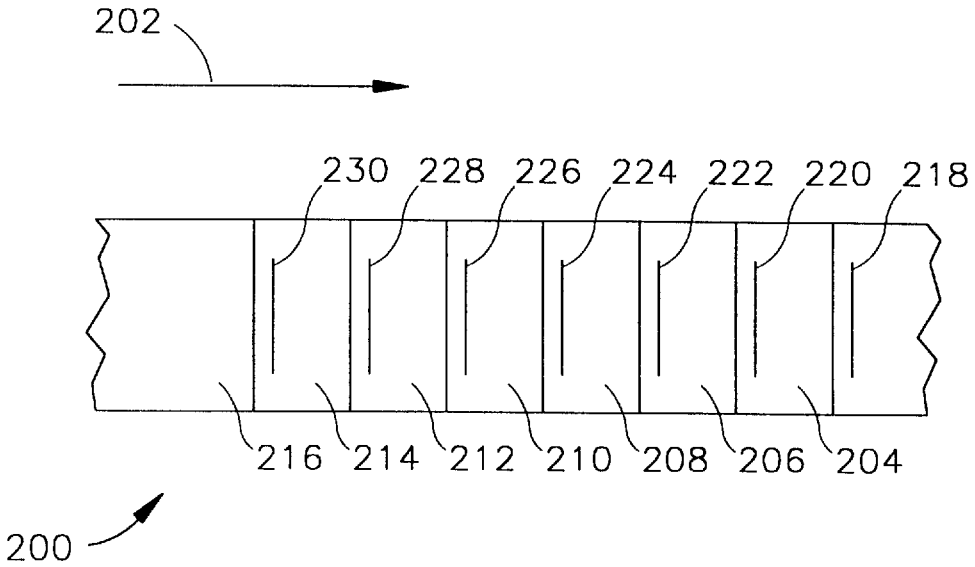
FIG. 5A shows in a top plan view a portion of a combination transfer ribbon having repeating units of color panels such as cyan, magenta and yellow, and also a longer panel such as black, including panel markers.

The foregoing discussion is further illustrated in FIG. 5A, which depicts a ribbon having repeating units of color panels such as cyan, magenta and yellow, and also an extended panel such as black. Of course, this aspect of the invention can also be implemented with respect, e.g., to ribbons in which the extended panel is of a clear layer suitable for printing a precoat layer on a substrate prior to color printing, or an overcoat layer after printing, and also to various other configurations of transfer material that will be known to those of ordinary skill in the art. (One such application lies in printing credit cards or driver's licenses that include a photograph of the subject: in such a case each color panel can be made in a size to match the photo image size, and a black panel can be made the size of the alphanumeric image field. Another example is the magnetic field of credit cards, which may be printed using a magnetizable ink panel of appropriate size; i.e., the ribbon may have panels of yellow, magenta, cyan, black and magnetizable ink.)

Specifically, FIG. 5A depicts a portion of a ribbon 200 which in use is moved in the direction of arrow 202, and in the portion shown contains sequentially adjacent color panels 204–214, which are of equal size (e.g., 8½ by 11 inches) and for illustrative purposes are shown oriented as just noted with the long dimension therof transverse to ribbon 200. The colors of panels 204–214 can be, e.g.: 204, yellow; 206, magenta; 208, cyan; 210, yellow; 212, magenta; and 214, cyan. (The extended panel 216 will be discussed further below.)

At a fixed distance d (as in FIGS. 3D, 3F and 4B, 4D but not shown in FIG. SA), within each color or black panel 204–216 there are located, respectively, panel markers 218–230. Each such marker indicates the color of the panel that it identifies, and also in which repeating unit of three (yellow, magenta and cyan) color panels the particular color panel is contained. Thus, if each repeating unit is identified by a unit index i, and if, for example, color panels 204–208 constituted the ith unit, color panels 210–214 would constitute the (i+1)th unit. Ribbon 200 contains just one black panel 216, not a part of any repeating unit.

More specifically, ribbon 200 may be made in a form, for example, that is 8,500 inches in length and 11 inches in width so as to encompass 1,000 copies. If in this case the relative panel sizes are 40 percent black and 60 percent in repeating units of yellow, magenta and cyan, there will be 600 panels of the latter colors (i.e., 200 of each color), hence there are 200 repeating color units and one long (3,400 inches) black panel (which may be designated as the 201st "unit"). In the example of ribbon 200 just discussed, since the last three color panels shown as panels 210–214 immediately precede the one black panel 216, the unit index i and color designations for the panels shown in FIG. 5A become as shown in the following table:

| panel number | unit index i | color | marker number |
|---|---|---|---|
| 204 | 199 | yellow | 218 |
| 206 | 199 | magenta | 220 |
| 208 | 199 | cyan | 222 |
| 210 | 200 | yellow | 224 |
| 212 | 200 | magenta | 226 |
| 214 | 200 | cyan | 228 |
| 216 | 201 | black | 230 |

The preceding table identifies the color panel of FIG. 5A in the first column, shows the unit index and color information pertaining to each such panel in the second two columns, and in the fourth column identifies the particular marker from FIG. 5A that includes each such set of information so as to be read by marker sensors in the printer and hence to permit appropriate longitudinal positioning of ribbon 200 for a desired use.

With regard to the color panels, it may suffice merely to establish that a panel of the appropriate color has been aligned under the energy source, as will be accomplished by marker sensors which read panel markers such as 218–228 from FIG. 5A. As to a long black panel such as panel 216, on the other hand, such an identification (e.g., by reading marker 230) will not suffice since it will be desired to utilize the entirety of panel 216. Consequently, means are required for determining the position of the energy source along the full length of panel 216, and such a means is illustrated in FIG. 5B.

Figure 5B:
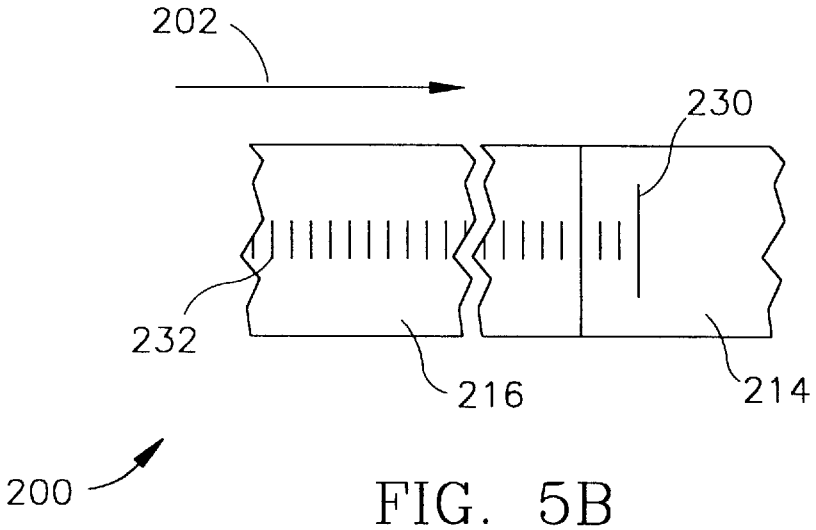
FIG. 5B shows an expanded view of the ribbon of FIG. 5A that shows distance markers within the longer panel.

Specifically, FIG. 5B is a larger scale view of a portion of FIG. 5A but in greater detail to show a series of distance markers 232 which extend, in even increments, from panel marker 230, which is located within and identifies panel 216 (i.e., as the 201st unit as just noted), through the remaining length of panel 214 and thence throughout the length of panel 216. Again, the location of distance markers 232 at or near the transverse center of ribbon 200 is exemplary only, and distance markers 232, like panel markers, can be located anywhere along a line extending across ribbon 200 so long as distance markers 232 are in line with an appropriate marker sensor such as marker sensor 120 as previously discussed. It is apparent from FIG. 5B that as ribbon 200 is moved in the direction of arrow 202 as before, successive ones of distance markers 232 will pass under such a marker sensor. Consequently, distance markers 232 are encoded to include information designating the specific position of ribbon 200 relative to the energy source, i.e., the distance along ribbon 200 that the ribbon has moved from the start of black panel 216. Using such information, the operator is able to move ribbon 200 manually to a desired position, or the printer will carry out such a move automatically as will be described hereinafter.

Distance markers 232 might not include positional information as such but would be counted as ribbon 200 is rolled forward so that appropriate counting circuitry—which would count both forwards and backwards as ribbon 200 was moved in either direction—would provide information as to the position of the ribbon relative to some panel marker such as marker 214. In a preferred embodiment, however, distance markers 232 will have encoded therein a specific location, e.g., distance markers 232 are spaced 0.25 inches apart, so that in proceeding leftward in FIG. 5B from panel marker 214, distance markers 232 are encoded in effect to read "0.25 inches," "0.5 inches," and so on to the end of panel 216, and similarly in the reverse direction when proceeding rightward in FIG. 5B.

Though such a procedure is not shown in FIG. 5B in order to preserve clarity in the drawing, the described use of distance markers 232 can also be extended through the color panels as well, as would be appropriate for use in the case of printing tasks in which it was known that in any instance, the use of one or another of the colors will extend through only a fraction of the panel, so that the remainder of that panel can be reserved for future use. Although for purposes of clarity the panel and distance markers of FIG. 5 are not repeated either in detail or at all in FIGS. 6–10 below, it will be understood that each of the ribbon embodiments shown in FIGS. 6–10 may also incorporate such markings.

The method of marking panels and distances within a panel as just described has further application with regard to the manufacture of ribbons such as ribbon 200. That is, it may not be economical to commit a ribbon manufacturing facility to the manufacture of but one kind of ribbon at a time. Greater flexibility is found in the ability first to manufacture ribbon segments that include particular panels, and then to form any desired kind of ribbon from a collection of such panels. The utility of the resultant ribbon, in terms of the ability to locate particular panels and locations therein as was just discussed, is preserved by the structure that places panel and distance markers within rather than outside the boundaries of the panel area. In this context, it also becomes preferable to place each panel marker within rather than ahead of the panel that it identifies, to avoid errors in identifying a following panel to be joined that in a subsequent panel collection process might not actually become joined.

Figure 6:
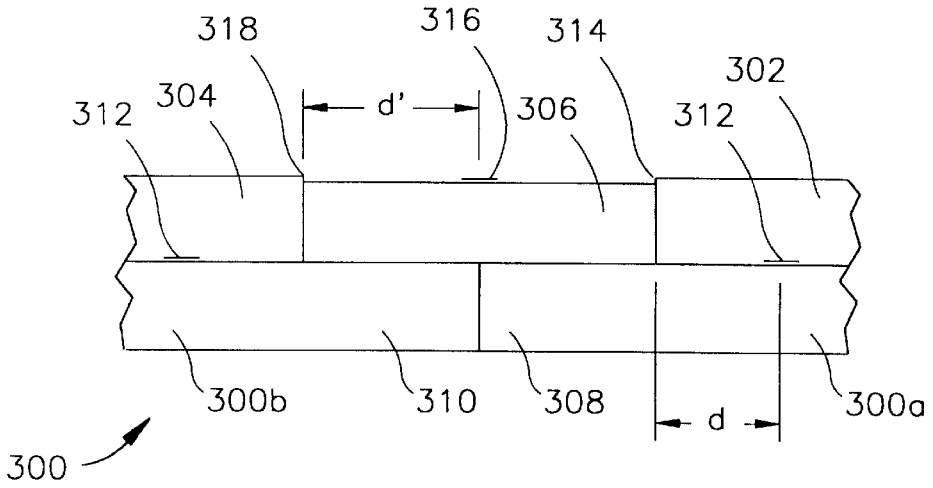
FIG. 6 shows in a side view an exemplary method of joining panel types so as to form a custom ribbon.

A procedure for joining ribbon panels is illustrated in FIG. 6, which shows in side view (highly exaggerated in the vertical direction of the figure) a generalized ribbon 300 consisting, firstly, of first and second ribbon segments 300*a*, 300*b* that respectively have placed thereon color panels 302 and 304; and secondly, a joining strip 306 that lies between color panels 302 and 304. In construction, ribbon segments 300*a*, 300*b* would ideally be placed in immediate abutment as shown in FIG. 6, and then strip 306, which may include a layer of glue (not shown) on the side thereof which faces ribbon segments 300*a*, 300*b* would be placed onto first and second end portions 308 and 310, respectively, of ribbon segments 300*a*, 300*b* which are not covered respectively by color panels 302 and 304, thereby effectively joining ribbon segments 300*a*, 300*b*. In practice, that ideal situation would not likely be realized, because of the difficulty in working with a ribbon medium that is, e.g,, just a few micrometers thick. Consequently, FIG. 6 must be understood as not necessarily being exact, e.g., first and second end portions 308, 310 may overlap, or not quite come into contact, etc. It is only necessary that strip 306 overlap first and second end portions 308, 310 sufficiently to effect a joinder of practical strength. (Alternatively, first and second end portions 308, 310 may be heat sealed together, or bonded in some other way.)

In a manner similar to that previously described, beneath color panel 302 at a distance d from end 314 of panel 302 there is placed a marker 312, which in this case identifies the following element of ribbon 300 not as a color panel but as a joining strip, i.e., strip 306 (or at least as a joinder of some kind). Since the boundary between first and second end portions 308, 310 of ribbon segments 300*a*, 300*b* may not be smooth (or may have collected glue, dirt or the like), it could be damaging to a print head or other energy source to come into contact with that boundary, hence the information provided by marker 312 that the ensuing ribbon element is in fact a joinder can be used to cause the energy source to be moved away from ribbon 300 using apparatus such as that in the Tektronix Phaser II thermal transfer printer, in the Watanabe et al. '236 patent, or the eccentric cam device in U.S. Pat. No. 4,709,242 issued Nov. 24, 1987 to Uchikata et al., the latter patent also showing and describing a type of electronic circuitry used to control lifting of the energy source and stopping the ribbon which is easily adaptable for control of energy source movement for present purposes. (The direction of motion of the energy source is shown by arrows 126 in FIGS. 4A–4D, and means for recording the position of the energy source in conjunction with the ribbon position, and hence to identify which portions of the ribbon have or have not been used, will be described below.) First and second end portions 308, 310 in particular, in addition to being of sufficient extent to ensure a firm bond to strip 306 (or to be heat bonded together, etc., as noted), must also have such extent to ensure that the energy source is moved away from the boundary between first and second end portions 308, 310 before that boundary comes into alignment with the energy source.

If used, strip 306, which need not be of a transparent material, may include on the outer surface thereof (opposite the surface facing ribbon segments 300*a*, 300*b*) a panel marker 316 that identifies the following panel 304, at a distance d' from the start 318 of panel 304. As before, if the printer is provided with marker sensors that respond to a magnetic rather than an optical signal, marker 316 can be positioned on or within the inner surface of strip 306. Marker 316 also includes information that identifies it as a marker located within a joining strip, and from that information the printer will be instructed to move the energy source back towards ribbon 300 in order to resume printing. Though not shown in FIG. 6, given that the use of distance markers such as markers 232 in FIG. 5B may be extended throughout all portions of such a joined ribbon in, e.g., ¼ inch increments, joining strip 306 would typically be of a size to incorporate a number of such markings shown as marker 316 in FIG. 6 rather than just the one.

It may be desired that d'>>d in order that the apparatus which moves the energy source back into proximity with ribbon 300 may have time to do so before any printing that will use panel 304 is to commence, or the printing process can be delayed electronically until a signal has been received (as will be described hereinafter) that the energy source has indeed been properly repositioned. Such a method of control is particularly important if a lifting device such as the eccentric cam device in the Uchikata et al. '242 patent is employed, since the eccentricity of such a cam is cut so as to ensure a slow and "soft" landing of the energy source onto the ribbon. Of course, if the energy source in a printer constitutes a laser device that remains positioned away from the ribbon in any event, the energy source lifting procedures just described become superfluous and can be eliminated. (In that case, the function of markers such as marker 312 would not be to provide for lifting of the energy source, but rather as a signal not to commence printing since the area to follow is not a printing area.)

Though the structure of FIG. 6 is not repeated in the following drawings, it should be understood that any or all of the ribbon embodiments that remain to be shown may in fact be fabricated, in whole or in part, using the joining technique described in connection with FIG. 6. In particular, in forming ribbons that employ two different technologies (e.g., thermal transfer and dye diffusion) in a single ribbon, it may be preferable to use the joining technique rather than seeking to deposit different transfer materials (e.g., ink and dye) onto a single medium. It is preferable for any ribbon so fabricated to be used with printers that either use a laser as an energy source or have the capability of lifting the energy source (e.g., a print head) away from the ribbon while moving past any such joint in order to protect that print head from damage. As shown in FIG. 6, it is also preferable that a marker 312 be located on each side of the joinder to provide warning of the presence thereof when ribbon 300 is moved in the opposite direction.

Figure 7:
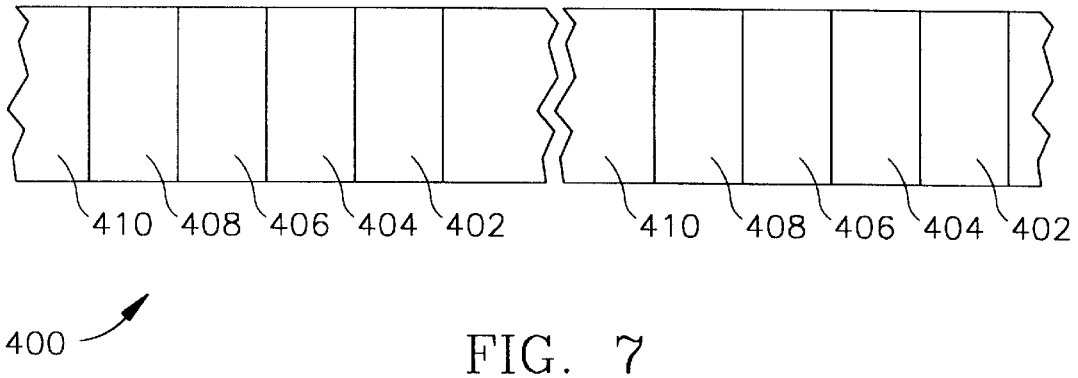
FIG. 7 shows in a top plan view a combination ribbon that includes a repeating unit consisting of four smaller color panels and one longer panel.

FIG. 7 shows another embodiment of the invention in which the ribbon consists of a repeating unit having a series of four smaller color panels and also one longer panel. Specifically, ribbon 400 includes in sequence a first color panel 402, a second color panel 404, a third color panel 406, and a fourth color panel 408, all of color panels 402–408 being of one size, as well as a 216 201 black 230 fifth panel 410 that is longer than color panels 402–408. Ribbon 400 further includes a multiplicity of repeating panel units that each include the aforesaid panel 402–410 sequence. (Just two repeating units are shown in the section of ribbon 400 in FIG. 7.) This particular embodiment provides means for carrying out specialized printing tasks.

For example, panel 410 may be black for printing on any substrate (i.e., on plain paper or a specially coated smooth paper) and the four color panels 402–408 may be for full color thermal transfer printing. In another example, long panel 410 may be black, and color panels 402–408 may be full color dye diffusion panels for photographic quality gray scale printing on specially coated paper. The advantage of this embodiment is that when such a ribbon 400 is installed, the printer can be used for photographic quality full color printing as well as low cost black printing without having to change the ribbon.

Figure 8:
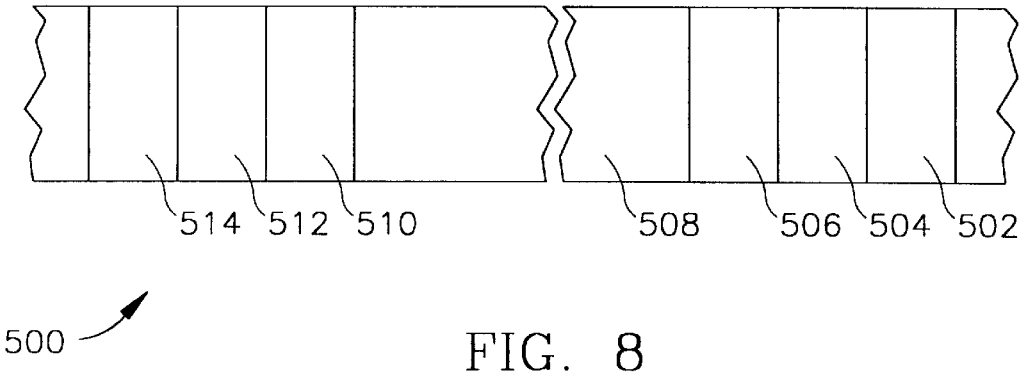
FIG. 8 shows in top plan view a combination ribbon that includes one long panel and two different repeating units of three color panels each.

FIG. 8 shows yet another embodiment of the invention in which the combination ribbon consists of one long panel, together with two different repeating units of three color panels each. Thus, ribbon 500 in FIG. 8 includes a first repeating unit consisting of first color panel 502, second color panel 504, and third color panel 506, followed by long panel 508, and then by a second repeating unit consisting of fourth color panel 510, fifth color panel 512, and sixth color panel 514. In one example of ribbon 500, long panel 508 has a clear coating, either to precoat on the substrate before printing or to overcoat after printing; the first three-color unit consisting of color panels 502–506 is of a one-time print type, and the second three-color unit consisting of color panels 510–514 is of a multi-print type useful for economical printing. If a transfer material capable of carrying out both precoating and overcoating were developed, panel 508 could of course be used for both such purposes. An example of this embodiment includes a ribbon 500 having a set of 10 long black panels 508 capable of printing on plain paper; one set of 20 repetitions of a first unit (e.g., panels 502–506) of dye diffusion panels suitable for printing on special paper; and one set of 20 repetitions of a second unit (e.g., panels 510–514) thermal transfer panels capable of printing on plain paper.

Figure 9:
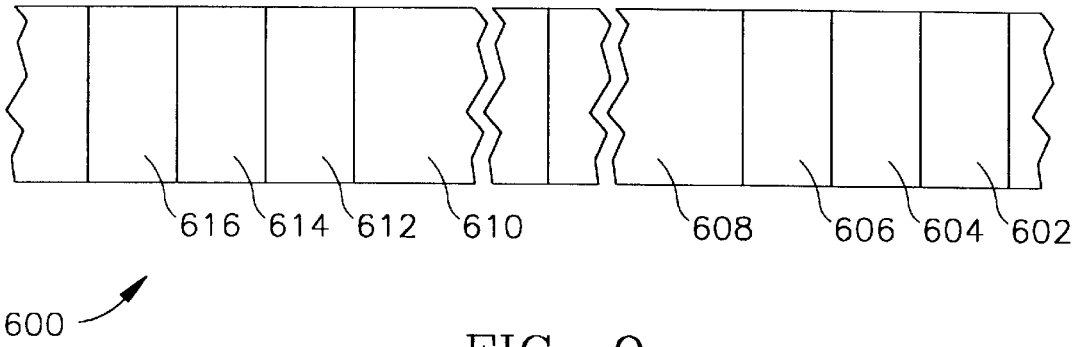
FIG. 9 shows in top plan view a combination ribbon that includes two different long panels and two different repeating units of three color panels each.

FIG. 9 shows still another embodiment of the invention in which the combination ribbon consists of two different long panels and two different repeating units of three color panels each. Specifically, FIG. 9 shows a combination ribbon 600 having a first repeating color unit consisting of three adjacent color panels, i.e., first color panel 602, second color panel 604, and third color panel 606; adjacent thereto is a first repeating single unit 608; adjacent thereto is a second repeating single unit 610; and adjacent thereto is a second repeating color unit having three additional color panels, i.e., fourth color panel 612, fifth color panel 614, and sixth color panel 616. The first (602–606) and second (612–616) color units, and also the first (608) and second (610) single units, can all be of different transfer materials. For example, single units 608, 610 may be of black and clear ink, respectively, and the first (602–606) and second (612–616) color units may be of different inks or dyes, or of different types of thermal transfer ink.

Figure 10:
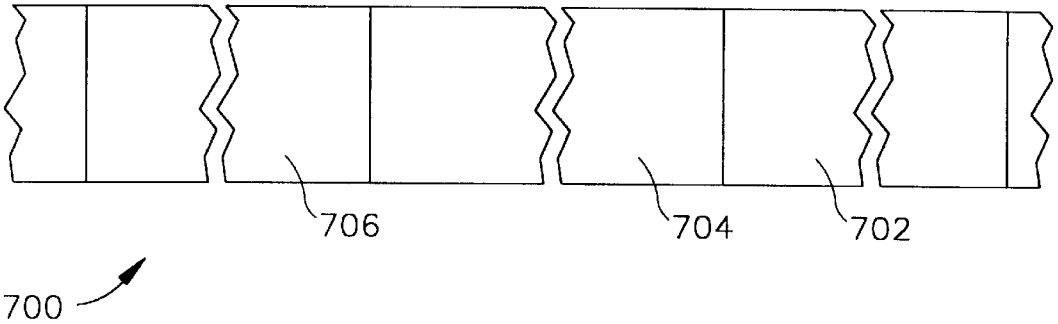
FIG. 10 shows in top plan view a combination ribbon that includes a single repeating unit of three long color panels.

FIG. 10 shows still another embodiment of the invention in which ribbon 700 comprises a single repeating unit of three long color panels, i.e., first color panel 702, second color panel 704, and third color panel 706. (As before, the colors may be: 702, yellow; 704, magenta; 706, cyan.) As one example, each of panels 702–704 can be 44 inches long, so that each panel can print four eleven-inch images, or for legal size printing each panel can print three fourteen-inch images, and only two inches of the panel would be wasted. Similarly, such an array of panels will print five multi-color images each 8.8 inches long, and so on. The disadvantage of the prior art, i.e., that (1) each panel was of the same size (or twice the size) as the substrate onto which the image was to be transferred; and (2) ribbon location was limited to selection of a panel, was that if the image size as to some one or more particular colors was smaller than the substrate, the unused portion of that panel was wasted. There may also exist within a particular image a span for which one or another color is not required, hence the corresponding span within the color panel becomes wasted. Had the above ribbon example included panels just fourteen inches in length to accommodate legal size printing, four prints of letter size (eleven inch) would result in wastage of twelve inches of ribbon. By employing panels of the larger (e.g., 44-inch) size, ribbon wastage is reduced, and it also becomes possible to print much larger images than standard paper sizes.

As in the previous embodiments, the lengths of each of color panels 702–704, though not necessarily equal, are preferably substantially longer than the dimension of the paper or other substrate onto which the printing is to take place, in order that each panel may be used for a number of image transfers. Ribbon 700 in FIG. 10 is conceived on the basis that any particular image transfer is expected to require only a portion of each color panel, and as the image receiving paper is moved relative to the energy source, ribbon 700 need be moved only as it is actually used.

Moreover, by recording in a look-up table the values of the distance markers at which image transfer is begun and terminated in each panel, a record can be made of which portions of each panel remain unused, and when returning to a panel, ribbon 700 can be moved to align those unused panel portions with the energy source so as to carry out additional printing. Such a movement of ribbon 700 can be carried out by the printer operator, by reading the position information provided from the position markers and then moving the ribbon until that information coincides with that in the look-up table as to unused ribbon portions, or the process may be automated, under computer control, through a SEARCH routine that locates such unused regions in a panel of a desired color. (Additional detail concerning apparatus required for such operations is given under "APPARATUS" below.)

Figure 11:
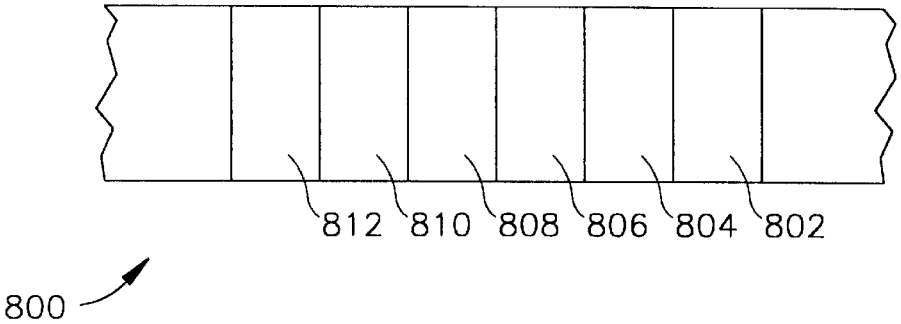
FIG. 11 shows in top plan view a combination ribbon that includes two different three-color repeating units.

In the example shown in FIG. 11, ribbon 800 has two repeating units of three colors each, i.e., first color panel 802, second color panel 804, and third color panel 806 constitute a first repeating unit in yellow, magenta and cyan, respectively, and fourth color panel 808, fifth color panel 810, and sixth color panel 812 constitute a second repeating unit, also in yellow, magenta and cyan, respectively, but different in some way from the first repeating unit. For example, one unit may be optimized for printing on plain paper, and another on special paper. Preferably, the two different repeating units of ribbon 800 are not interdispersed, but ribbon 800 comprises one length in which the first repeating unit (panels 802–806) is repeated through perhaps half the length thereof, and the second repeating unit (panels 808–812) is repeated through the remainder, so as to separate the two different panel groups. (In other words, the particular portion of ribbon 800 that was selected to be shown in FIG. 11 is that at which the changeover is made from the one panel group to the other. In any such change, but especially when the two panel groups on a single ribbon use different transfer materials such as ink or dye, there may be one or more panels for which the transfer material deposited is of lesser quality, and it may be appropriate in that case to instruct the printer to skip over one set or so of panels. Alternatively, any ribbon such as that shown in FIG. 11 may preferably be constructed by means of joinder at the indicated changeover, for which the printer will move the ribbon past the joinder before resuming printing as previously noted.) By that procedure, extensive ribbon movement is required only when changing from one variety of printing to the other, e.g., when changing paper or printing tasks and correspondingly from one half of ribbon 800 to the other, and it will not be necessary in the course of one printing task to move ribbon 800 over unusable interspersed panels that are intended for the other printing.

APPARATUS

Figure 12A:
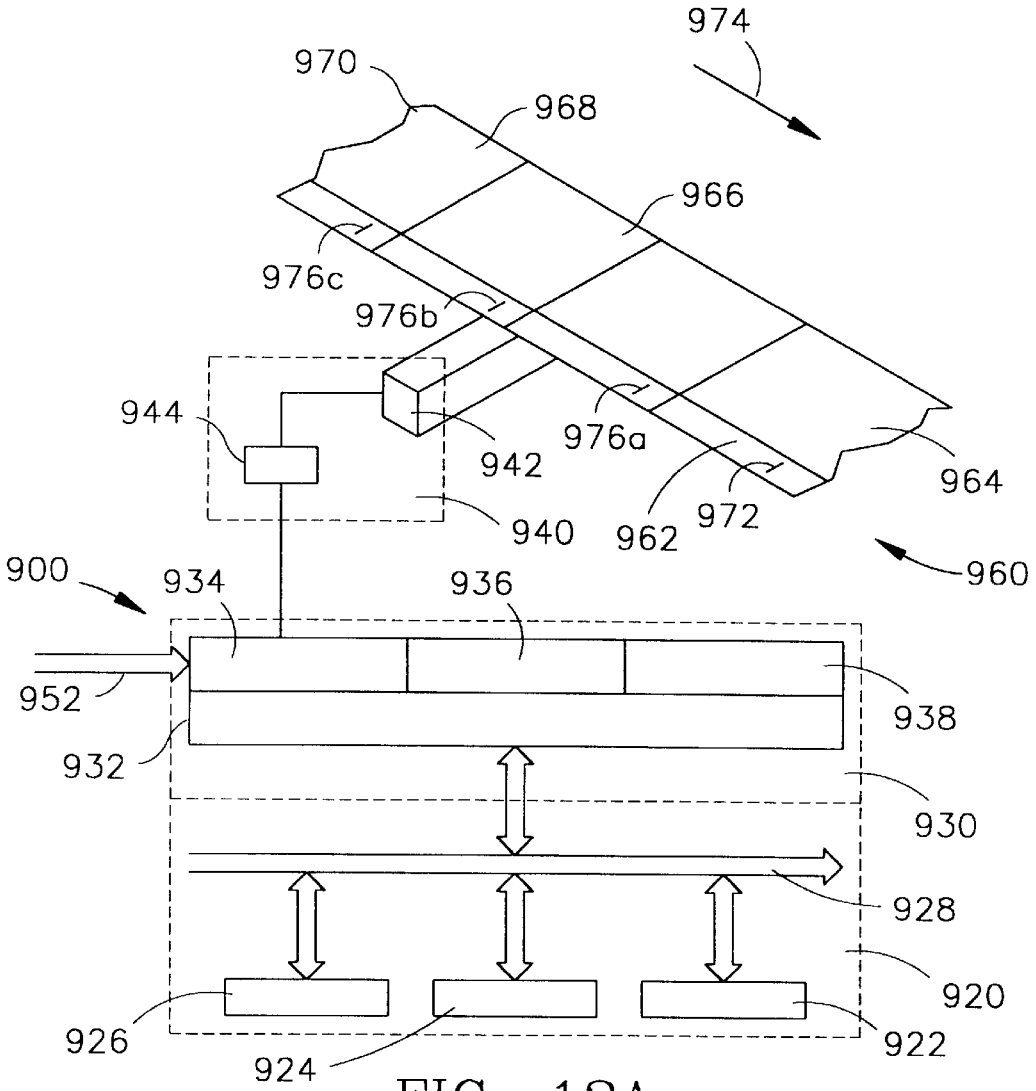
Figure 12B:
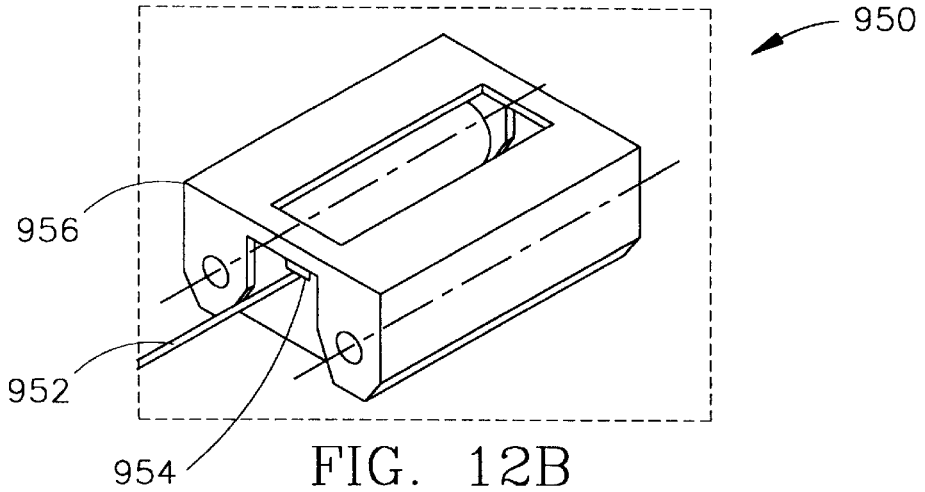

The specific aspects of the apparatus that are involved in the invention are shown in an exemplary embodiment in FIG. 12, which depicts in schematic form (in FIG. 12A) a ribbon control system 900 that comprises electronic system 920, printer control system 930, ribbon tracking system 940, and (in FIG. 12B) cassette system 950. Electronic system 920 further comprises microprocessor 922, memory 924, and user interface 926, all of which are connected to a common bus 928. Except where otherwise stated with reference to some particular aspect of the invention, the various components of electronic system 920 are entirely conventional in nature and will not be additionally described.

Printer control system 930 connects with electronic system 920 as shown in FIG. 12 and further comprises controller 932 which connects with ribbon control 934, print control 936, and substrate control 938. Through each of ribbon control 934, print control 936, and substrate control 938, printer controller 932 serves respectively to move the ribbon to desired locations and accept ribbon and position information therefrom as will be described below; to transmit print data (and indicate when printing has occurred), and to raise and lower the energy source (when necessary) as previously described; and to advance the image receiving substrate. The printer operator is enabled to monitor and control such operations by interface 926, which may, e.g., be a conventional set of push buttons and LEDs or the like. Memory 924 serves to accumulate data as to the nature of the installed ribbon and what portions thereof have been used. Acting through common bus 928, and on the basis of instructions received through interface 926, microprocessor 922 executes control of all of the aforesaid functions in the usual manner.

In a preferred embodiment, ribbon tracking system 940 further comprises a bar code scanner 942 that connects to a digitizer 944, which in turn connects to ribbon control 934. The prior art, in using a ribbon encoded with double and single markers such as 22*a* and 24*a* (identifying the start of particular color panels) of FIG. 1, would employ, e.g., a light source, sensor, amplifier, A/D converter and register. The prior use of bar codes has evidently been limited to conveying that same kind of information or, e.g., the amount of remaining ribbon. The embodiment of FIG. 12, however, employs bar code scanner 942 and digitizer 944 to communicate more information concerning the ribbon and the accumulated usage thereof.

(Digitizer 944 is not essential to the operation of the invention, but can be included if desired to convert the code ordinarily received from a bar code scanner into a more convenient digital form for further processing. Of course, if digitizer 944 is not used, microprocessor 922 must be programmed to operate upon the bar code scanner information directly.)

Cassette system 950 shown in FIG. 12B further comprises cable 952 connected at one end to ribbon control 934 within printer control system 930 and at the other end to memory chip 954 attached to cassette 956. (Cassette 956 contains a ribbon such as ribbon 960.) The purpose of cassette system 950, and especially of memory chip 954, is to receive data similar to that accumulated by memory 924, as will be hereinafter described, concerning the ongoing usage of the ribbon. Memory chip 954 may comprise any type of non-volatile memory, e.g., as powered by a battery (not shown), in order that such accumulated ribbon usage data will not be lost if it becomes necessary to remove cassette 956 from the printer (e.g., for purposes of overnight data security, an exchange of ribbons, or the like).

Ribbon tracking system 940 functions in relation to an installed ribbon 960, which is generally one of the types previously described. For ease of illustration, ribbon 960 is shown conceptually in FIG. 12A as having a transparent base 962 including a transparent leader 964 region onto which have been deposited a series of color panels 966, 968, 970 of shorter dimension than the width of base 962 so that a strip of base 962 along one side thereof remains transparent.

In the region of base 962 represented by leader 964 and (in this figure) at one side thereof, ribbon 960 includes, in bar code disposed transversely to the long dimension of ribbon 960, an identification marker 972 that identifies which, of a number of varieties that the printer can accommodate (e.g., the various ribbon types shown in FIGS. 2–11), that the particular ribbon constitutes. Within the printer, memory 924 incorporates a preestablished look-up table that incorporates all relevant information concerning that ribbon, and also concerning each of the other ribbon types that the printer can accommodate, e.g., whether the ribbon employs conventional thermal transfer, dye diffusion or some other technology in which panels, how many panels it has, what are the colors, lengths, and relative disposition of each, and so on. On the basis of such information and correlated information preestablished within memory 924 (including the locations on the ribbon of each panel and the dimensions and colors of each, etc.), microprocessor 922 is enabled, e.g., to adjust through print control 936 the amount of force with which a print head should be urged against the ribbon, and the power levels, pulse widths and repetitions per pixel of the data signals to be sent to the particular type of energy source.

In other words, based upon previous research concerning each type of ribbon, a set of optimum operational parameters will have been determined and written into look-up tables within memory 924 for each, and when one or the other type of ribbon that has so been characterized is installed in the printer, bar code scanner 940 reads identification marker 972 and conveys the type identification so found to electronic system 920, whereupon microprocessor 922 directs inquiry to memory 924 for the operational parameter data associated with the ribbon type so identified. Such data are then conveyed, as necessary, to ribbon control 934 and print control 936 so as to control subsequent printing operations accordingly.

In terms of ascertaining and controlling the location of ribbon 960 as it passes through the printer (e.g., in the direction of arrow 974), a series of panel location marks 976*a*, 976*b*, 976*c*, etc., is disposed along the one side of base 962 that is aligned with bar code scanner 942, marks 976*a*, 976*b*, 976*c*, etc. also being in bar code disposed transversely to the long dimension of ribbon 960 so as to permit immediate scanning thereof as ribbon 960 is moved forward. Marks 976*a*, 976*b*, 976*c* are shown in FIG. 12A as being disposed on the side of ribbon 960 opposite bar code scanner 942, but since in this example they lie in a region of ribbon 960 that is transparent they can be read from that opposite side. (Again, that will be true of magnetic marks even if that part of ribbon 960 were not transparent.)

As previously described, panels 966, 968, 970 may, e.g., constitute the first of a number of sets of yellow, magenta and cyan color panels, and since FIG. 12A shows just that part of ribbon 960 that is immediately after the leader 964, in that case the specific information contained within marks 976*a*, 976*b*, 976*c* will be: 976*a*—set one, yellow; 976*b*—set one, magenta; 976*c*—set one, cyan. If desired, intervening space markers that extend through the length of a panel, such as markers 232 shown in FIG. 5B, can also be included along this one side of ribbon 960. The manner of encoding similar marks, with respect to different locations within ribbon 960 or as to ribbons that have other panel sequences or the like, will be easily understood from this example.

It should be noted that information such as that concerning whether a particular panel employs thermal transfer or dye diffusion technology or the like need not be included within panel location marks 976*a*, 976*b*, 976*c*: identification mark 972 will have conveyed to memory 924 the information, e.g., that the 21st set of panels employs dye diffusion technology, and during the course of operation, upon noting from bar code scanner 942 that the 21st set of panels has arrived at the energy source, microprocessor 922 will then act through print control 936 to make any changes that might be necessary in the operating parameters. On the other hand, if memory 924 is volatile and hence will lose such information if there is a loss of power (e.g., a power failure), it becomes preferable to include information concerning ribbon characteristics within each panel location mark 976*a*, 976*b*, 976*c*, etc., in order to avoid any need to return ribbon 960 to its initial (loading) position so as to again read identification mark 972.

If the ribbon characteristics information is indeed held in memory 924, upon indication through bar code scanner 942 that ribbon 960 is at some particular location, if some other location is desired in order to carry out a printing operation that would not result from use of the ribbon as so positioned, through interface 926 the operator can bring about the desired ribbon movement, either directly as in "go to panel set 100" or indirectly (through microprocessor 922 and memory 924) as in "go to next black panel." The location along ribbon 960 of that "next black panel" relative to the location then indicated by bar code scanner 942 is stored within memory 924, having been ascertained from identification of the ribbon type by way of bar code scanner 942 and identification marker 972 or otherwise, and microprocessor 922 then ascertains that location and instructs ribbon control 934 to move ribbon 960 accordingly.

The following description will indicate how an operator can obtain a motion such as "go to next unused black panel." It has already been indicated that through the use of bar code scanner 942 and various markers, the position of the ribbon is known at any time. Such knowledge may be derived only in terms of which panel of which set is then located at the energy source, or it may also include information as to position within that panel. (In this case, the instruction might be "go to next unused bit of black ink or dye"—and with ribbons containing two types of thermal transfer ink the choice therebetween could also be indicated.) The latter information can come either from the use on ribbon 960 of intervening space markers such as markers 232 shown in FIG. 5B, or by counting ribbon drive motor pulses after a particular panel marker, e.g., 976*a*, 976*b*, or 976*c*, etc., has been read. Corresponding to the various motions of ribbon 960, then, it is only necessary, through print control 936, to maintain a record of those times during such motions of ribbon 960 that, e.g., the print head was down and thus was presumably printing so as to use the portion of ribbon 960 adjacent thereto, or was up so that the corresponding ribbon portions would be unused, or by other means to indicate that printing had occurred.

One method of making a record of print head position as an indicator of ribbon usage is to provide in memory 924, parallel to the ribbon characteristics information defined by the look-up table appropriate to the particular ribbon type, a blank single bit array in which each bit represents a predetermined distance such as a part of an inch or some number of pixel widths along the ribbon. Thereupon, at any time (i.e., at any ribbon position) that the print head is down (having been so placed by means of the apparatus earlier referred to), a series of 1's will, by way of print control 936, be written into that bit array of memory 924 as a secondary consequence of the same signal that places the energy source down. Similarly, in printers in which the image-receiving paper is held on a drum, it is typical that the drum drives the paper during the printing process, but when not printing the paper Is driven forward by the platen and a pinch roller. Thus, the "ribbon usage" data (i.e., an instruction to write 1's into the region of memory 924 corresponding to the then-existing position of ribbon 960) can in this case be derived from the signal which operates the drum. Such a method would be applicable, for example, in the case that the energy source is a laser device that in fact is not moved up and down. Of course, indication that the energy source is in use can be derived perhaps most directly from the image signal that must be sent to the energy source. In substance, however, in these or any similar such cases, to find the "next unused black panel" (or portion thereof) merely requires microprocessor 922 firstly to find the "next black panel" from the information in the relevant look-up table and then, from the "energy source in use" data so accumulated in memory 924 by way of print control 936, to find some portion, if any, of that black panel during the transit of which past the energy source the latter is not shown to have been in use (i.e., the corresponding portion of the aforesaid bit array contains only 0's).

In other words, the data that have been previously programmed (or hard-wired) into memory 924 that pertain to each type of ribbon will constitute a "map" thereof, and in case a new ribbon is loaded into the printer, no "use" data will have been accumulated and all panel areas thereon will be detected as being unused. Upon any use thereafter, the aforesaid procedure will write 1's into that "memory map" in those ribbon areas in which the energy source is shown by print control 936 to have been in use, and through the action of microprocessor 922 such ribbon areas will no longer be accessible for use.

That same writing of "use data" will be transmitted through cable 952 into memory chip 954 which is attached to cassette 956 as shown in FIG. 12, so that if cassette 956 is removed from the printer and then reinstalled, the ribbon use data will again be made available. To ensure that the printer (i.e., electronic system 920) operates from a correct set of use data, a switch (not shown) may be installed that will be tripped upon any installation of a ribbon, whether the ribbon so installed has been previously used or not, whereupon microprocessor 922 will be instructed to erase whatever use data may still exist within memory 924 (e.g., the use data of a different ribbon that has just been removed) and copy out the use data that is stored within memory chip 954 before commencing printing operations. Since an operator may wish to remove a ribbon (perhaps known to be almost fully used) and replace it with another ribbon of identical type, it is further preferred that identification mark 972 also include a serial number pertaining to the individual ribbon so that the instruction just stated will still be carried out, i.e., the change in serial number will indicate that a change of ribbon was carried out and thus the use data appropriate to that new ribbon will be loaded. If memory 924 within the printer should be volatile or fail and thus contain no data after the printer has been shut off, at any time the printer is then turned back on microprocessor 922 will simply be instructed to copy out the use data in memory chip 954 before commencing printing operations. To encompass the case in which cassette 956 does not contain a memory chip 954 (also detectable from identification mark 972 upon the cassette being loaded) or fails and hence no ribbon usage data is available, at least in those cases in which the ribbon contains only equal-sized sets of panels, electronic system 920 can at least be given an alternative instruction to skip any remaining panels of the current set and move forward to the next set of such panels.

The procedure just described whereby electronic system 920 is instructed to locate unused ribbon areas constitutes the SEARCH procedure mentioned earlier. Manual intervention by the operator lies in instructing electronic system 920 to traverse ribbon 960 to some particular panel or set of panels. If the SEARCH procedure were used consistently, at any time the ribbon would mostly include only panels that were used in their entirety, and perhaps a panel of each kind (color, etc.) out of the last group of panels used that had been used only in part. After any manual intervention, on the other hand, there might be produced quite a number of partially used panels. In that case, the operator would have the option of reverting to the SEARCH procedure so as to "pick up" and use all such scattered panel portions, which would help avoid ribbon wastage but require some expenditure of time, or the operator may again choose to intervene by seeking out a set or group of entirely unused panels for more rapid printing.

It will be understood by those skilled in the art that other arrangements and dispositions of the aforesaid components, the descriptions of which are intended to be illustrative only, may be made without departing from the spirit and scope of the invention, which must be determined only from the following claims and equivalents thereof.

I claim:

1. A ribbon for use in a non-impact printer comprising:

an elongate foundation having a beginning end, a terminal end, and oppositely facing sides;

a first panel group comprised of first transfer materials carried on the foundation for transferring an image from the foundation to a substrate; and a second panel group comprised of second transfer materials carried on the foundation for transferring an image from the foundation to a substrate;

the first transfer materials comprising, in combination, an ink, means for releasing the ink, and means for adhering the ink to the substrate in a thermal transfer process;

the second transfer materials comprising dye diffusion type of transfer materials different from the first transfer materials for transferring an image to the substrate using a sublimation transfer process;

sad first and second panel groups are disposed on one of said sides of said foundation to respective predetermined lengths thereon; and wherein at least one of said first and second panel groups comprises repeating panels of yellow, magenta and cyan transfer materials.

2. A ribbon according to claim 1 wherein at least one of sad first and second panel groups includes at least one panel of a magnetically readable material.

3. A ribbon according to claim 1 wherein at least one of said first and second panel groups comprises multi-print transfer material; and at least another one of the panel groups comprises a single-print type of transfer material.

4. A ribbon according to claim 1 wherein at least one of said first and second panel groups includes at least one panel of an overcoat material.

5. A ribbon according to claim 1 wherein at least one of said first and second panel groups includes at least one panel of a precoat material.

6. A ribbon according to claim 1 wherein at least one of said first and second panel groups includes at least one panel of a precoat/overcoat material.

7. A ribbon according to claim 1 wherein:

at least one of said first and second panel groups comprises repeating panels of respective predetermined lengths; and another one of the panel groups consists of a single, continuous panel of transfer material.

8. A ribbon according to claim 1 wherein:

the first panel group includes at least one panel of black transfer material having a length greater than the length of any individual one of the panels of the second panel group; and the second panel group comprises repeating panels of transfer material.

9. A ribbon according to claim 1 wherein each of said first and second panel groups includes at least one panel of an overcoat material.

10. A ribbon according to claim 1 wherein each of said first and second panel groups includes at least one panel of a precoat material.

11. A ribbon for use in a non-impact printer comprising:

an elongate foundation having a beginning end, a terminal end, and oppositely facing sides;

a first set of panels carried on the foundation and comprised of first thermal transfer materials formulated so as to respond to a first level of thermal energy for transferring an image from the foundation to a substrate; and at least a second set of panels carried on the foundation and comprised of second thermal transfer materials different from the first thermal transfer materials and formulated so as to respond to a second level of thermal energy different from the first level of thermal energy for transferring an image from the foundation to a substrate wherein at least one of said first and second sets of panels comprises a multi-print transfer material and another one of the sets of panels comprises a single-print type of transfer material.

12. A ribbon according to claim 11 wherein:

said at least one of said first and second sets of panels comprises repeating panels of yellow, magenta and cyan multi-print transfer material.

13. A ribbon according to claim 11 wherein at least one of said first and second sets of panels includes at least one panel of an overcoat material transferable to a paper after printing an image onto the paper for protecting the printed image.

14. A ribbon according to claim 11 wherein at least one of said first and second sets of panels includes at least one panel of a precoat material.

15. A ribbon according to claim 11 wherein at least one of said first and second sets of panels includes at least one panel of a precoat/overcoat material.

16. A ribbon for use in a non-impact printer comprising:

an elongate foundation;

a first set of panels carried on the foundation, each of the first set of panels comprised of a multi-print thermal transfer material for printing multiple predetermined images onto a printing substrate responsive to multiple applications of thermal energy to the panel; and at least a second set of panels carried on the foundation, each of the second set of panels comprised of single-print thermal transfer materials for printing no more than a single predetermined image onto the printing substrate responsive to a corresponding single application of thermal energy to the panel;

whereby a user of the ribbon can selectively employ either single-print or multi-print thermal transfer material without having to change ribbons.

17. A ribbon according to claim 16 wherein the at least one of the sets of panels is comprised of a repeating series of panels of cyan, magenta and yellow thermal transfer materials.

18. A ribbon for use in a non-impact printer comprising:

an elongate foundation;

a first set of panels carried on the foundation and comprised of first thermal transfer materials formulated so as to respond to a first level of thermal energy for transferring an image from the foundation to a substrate; and at least a second set of panels carried on the foundation and comprised of second thermal transfer materials different from the first thermal transfer material and formulated so as to respond to a second level of thermal energy different from the first level of thermal energy for transferring an image from the foundation to a substrate;

wherein at least one of the first and second panel groups comprises a multi-print transfer material and another one of the panel groups comprises a single-print transfer material.

* * * * *